US007927262B2

(12) United States Patent
Clark

(10) Patent No.: US 7,927,262 B2
(45) Date of Patent: Apr. 19, 2011

(54) COMPACT MULTI-FUNCTION EXERCISE APPARATUS

(76) Inventor: David Jon Clark, Savage, MN (US)

( * ) Notice: Subject to any disclaimer, the term of this patent is extended or adjusted under 35 U.S.C. 154(b) by 0 days.

(21) Appl. No.: 12/583,290

(22) Filed: Aug. 18, 2009

(65) Prior Publication Data

US 2010/0144497 A1 Jun. 10, 2010

Related U.S. Application Data

(63) Continuation of application No. 11/787,307, filed on Apr. 16, 2007, now Pat. No. 7,575,538.

(51) Int. Cl.
*A63B 21/062* (2006.01)

(52) U.S. Cl. ..... 482/103; 482/138; 482/142

(58) Field of Classification Search ..... 482/92, 482/93, 99–103, 138, 142
See application file for complete search history.

(56) References Cited

U.S. PATENT DOCUMENTS

| | | | |
|---|---|---|---|
| 332,989 | A | 12/1885 | Benedict |
| 382,440 | A | 5/1888 | Sanchez |
| 723,625 | A | 3/1903 | Thomley |
| 2,977,120 | A | 6/1959 | Morris |
| 4,199,139 | A | 4/1980 | Mahnke et al. |
| 4,402,504 | A | 9/1983 | Christian |
| 4,431,181 | A | 2/1984 | Baswell |
| 4,549,733 | A | 10/1985 | Salyer |
| 4,603,855 | A | 8/1986 | Sebelle |
| 4,624,457 | A | 11/1986 | Silberman et al. |
| 4,709,918 | A | 12/1987 | Grinblat |
| 4,809,972 | A | 3/1989 | Rasmussen et al. |
| 4,826,157 | A | 5/1989 | Fitzpatrick |
| 4,834,367 | A | 5/1989 | Salyer et al. |
| 4,898,381 | A | 2/1990 | Gordon |
| 4,976,428 | A | 12/1990 | Ghazi |
| 5,018,725 | A | 5/1991 | Cook |
| 5,069,447 | A | 12/1991 | Snyderman et al. |
| 5,082,259 | A | 1/1992 | Gonzalez |
| 5,135,453 | A | 8/1992 | Sollenberger |
| 5,211,614 | A | 5/1993 | Henes |
| 5,328,428 | A | 7/1994 | Huang |
| 5,462,510 | A | 10/1995 | Ish, III |
| 5,466,204 | A | 11/1995 | Nearing |
| 5,470,299 | A | 11/1995 | Yeh |
| 5,725,459 | A | 3/1998 | Rexach |
| 6,019,704 | A | 2/2000 | Morgan |

(Continued)

FOREIGN PATENT DOCUMENTS

DE 19704390 A1 9/1997

(Continued)

OTHER PUBLICATIONS

Nautilus, NS700X Brochure,2006.

(Continued)

*Primary Examiner* — Jerome W Donnelly

(57) ABSTRACT

An exercise apparatus that provides a complete body workout, folds up into a small footprint, and can be hidden inside of a closet or decorative cabinet. The two arms rotate both horizontally and vertically, and move up and down, permitting the cable ends to be positioned anywhere from near the ground to well over head, thus allowing for infinite exercise variation. Cable ends that exit the arms freely and move independently of each other simulate working out with free weights. The counterweighted arms combined with convenient locking levers facilitate rapid and effortless arm repositioning. A counterweighted fold out seat assembly with leg extension completes the versatile and compact workout station.

10 Claims, 25 Drawing Sheets

U.S. PATENT DOCUMENTS

| | | | | |
|---|---|---|---|---|
| 6,217,493 | B1 | 4/2001 | Spletzer | |
| 6,315,702 | B1 | 11/2001 | Ikonomopoulos | |
| 6,443,877 | B1 * | 9/2002 | Hoecht et al. | 482/103 |
| 6,447,430 | B1 | 9/2002 | Webb et al. | |
| 6,458,061 | B2 | 10/2002 | Simonson | |
| 6,488,612 | B2 | 12/2002 | Sechrest et al. | |
| 6,592,498 | B1 | 7/2003 | Trainor | |
| 6,685,601 | B1 | 2/2004 | Knapp | |
| 6,755,770 | B2 | 6/2004 | Martens | |
| 6,921,355 | B2 * | 7/2005 | Campanaro et al. | 482/95 |
| 2002/0091043 | A1 | 7/2002 | Rexach | |
| 2003/0045406 | A1 | 3/2003 | Stone | |
| 2003/0176261 | A1 | 9/2003 | Simonson et al. | |
| 2004/0005966 | A1 | 1/2004 | Chen | |
| 2004/0018920 | A1 | 1/2004 | Simonson | |
| 2005/0096197 | A1 | 5/2005 | Webber et al. | |
| 2006/0116249 | A1 | 6/2006 | Dibble | |
| 2006/0189457 | A1 * | 8/2006 | Ripley | 482/99 |

FOREIGN PATENT DOCUMENTS

| | | | |
|---|---|---|---|
| DE | 19801672 | A1 | 11/1998 |

OTHER PUBLICATIONS

Cybex,FT-450 Brochure, Feb. 2009.
Bodycraft, PFT Functional trainer,2009.

* cited by examiner

F
F
F
42C
125
120
F
152
42B
GC
G
54A
94
54B
G
RS
GC
G
42A
74B
136
68A
110
G
RS
74A
68B
129
78A
80A
114
A
A
80B
78B
F
F
F

156A
A
134
F
F
112A
112B

F
F
152
F
F
F
125
120
42A
94
G
RS
74B
74A
136
68A
110
68B
42B
G
RS
78A
80A
129
A
114
A
80B
78B
F
F
F
134
156A
A

F
F
112A
112B

113A + 115A = 111

113B + 115B = 111

113C + 115C = 111

113A + 115A = 117A

113B + 115B = 117B

113C + 115C = 117C

117A ≠ 117B ≠ 117C

COMPACT MULTI-FUNCTION EXERCISE APPARATUS

CROSS REFERENCE TO RELATED APPLICATIONS

This application claims the benefit of: Provisional Patent Application No. 60/565,384 filed 2004 Apr. 26 by David Clark, Utility patent application Ser. No. 11/114,450 filed 2005 Apr. 26 by David Clark, and of Utility Continuation patent application Ser. No. 11/787,307 filed Apr. 16, 2007 now U.S. Pat. No. 7,575,538 by David Clark.

FIELD OF THE INVENTION

This invention relates to multi-purpose exercise equipment that uses cables to transfer force from a resistance source to user interfaces and also to apparatus that have elements that pivot, translate, and transfer forces with cables.

BACKGROUND OF THE INVENTION

There are mainly two different methods to do strength training and both have their inherent strengths and weaknesses. The first is to exercise with free weights and the second is to exercise with exercise machines that use cables to transfer the forces from a resistance source to a user.

The advantage of free weights is that they're very effective in producing strength gains and muscle mass. This is, in part, because the weight is unguided, and therefore secondary muscles get involved during the exercise in order to balance the weight. One of the inherent problems with free weights is that exercising with them is not as safe as exercising with an exercise machine. A lifter can lose his balance and be injured in a fall. The lifter may not be able to finish a lift, in which case he can become pinned under a bar. Plates can slide off the bar during a lift, potentially causing injury to the lifter and most likely to the floor. Lifting with free weights is also time consuming because of the need to take weight plates on and off to change the resistance, and because of the need to move the bar to different positions on the bar rack for different exercises. Also the lifting area can become cluttered with weight plates, thereby causing a hazard and making it difficult to locate desired weigh plates. In addition, some body parts are best worked out with an exercise machine, such as using a cable pulldown machine for working out the back. Furthermore, cost can be a factor. A lot of equipment is needed to be able to do a complete free weight workout, such as, the free weights, dumbbells, various lifting bars, a bench that inclines and declines, a bar rack for holding the barbell in several locations, and a cable pulldown machine. Purchase of all of this equipment can get quite expensive. Since free weights and free weight equipment are not designed to be compact or stored out of view, typically a whole room needs to be dedicated to such a setup.

Some of the advantages of exercise machines that make them so popular are because they overcome many of the disadvantages of free weights. They're safer to use than free weights as there is no risk of falling, of being trapped by the weights, or of having the weights fall off. Because the source of resistance is typically a weight stack where the weights are confined, the weights don't get scattered, lost, or dropped on the floor, and changing the amount of weight is quickly achieved by just changing the position of the selector pin. Many different exercises can be performed on one machine, and some exercise machines have multiple workout stations and weight stacks to permit performance of the various exercises needed for a complete body workout. Since it is possible to quickly and easily change between different exercises and resistance levels, circuit weight training is possible.

Circuit weight training was developed to promote both aerobic and muscular fitness at the same time. It consists of a series of exercises performed in succession, with a maximum of 30 seconds of rest between exercises, and lasting a total of 30 minutes. In order to maintain such a pace, an exercise machine must allow for a very quick and smooth transition between the different exercises and resistance levels, or there needs to be many different workout stations to allow all the different exercises needed to get a full body workout.

One of the problems with exercise machines is that they take up a lot of floor space. While some take up a smaller amount of floor space than others, typically they are all free standing and need to be set up far enough away from walls and furniture in order to allow for the space necessary to move around them and to exercise freely. Most exercise machines are designed such that only a certain number of body parts can be exercised per workout station. This is because the typical workout station is dedicated to doing specific exercises, such at a high pull station for doing pulldowns, or a low pull station for curls, or a station dedicated to doing the bench press or squats, etc. Exercise machines with these kinds of dedicated workout stations must have multiple workout stations for the user to get a full body workout. These larger machines require more steel, pulleys, and parts, resulting in a more complicated and expensive exercise machine that takes up more floor space.

Some inventions have attempted to deal with the problem of dedicated workout stations by allowing a set of pull points (the point at which individual hand grips or a bar is attached) to be adjustable in space. Some have achieved this by allowing the pull points to be adjusted vertically such as shown in U.S. Pat. Nos. 4,549,733; 4,603,855; and 4,898,381. One of the problems to be overcome by doing this is what to do with the excess cable as the pull points are moved. How complicated is the method for taking up the cable slack from moving the pull points? Another method to adjust the pull points in space is to position the pull points at the distal end of an arm, but the pivot of the arms is from a fix location that limits their versatility. Examples of this are shown in U.S. Pat. Nos. 4,826,157; 6,458,061 and 6,488,612. Cable length is constant but the arms pivot from a fixed pivot point.

For a lot of exercises a user may prefer to use a bar between the pull points. Some exercise machines that utilize pull points that move up and down are only designed to use individual hand grips. Some reasons a straight bar can't be used is because the vertical guides are spaced to closely together, the vertical guides aren't parallel to one another, and there is no space between the pull points (or arms) either because the arms are too short or there is structure directly between the pull points which prohibit the ability to do meaningful straight bar exercises like squats. Some examples of gyms that have one or more of these flaws are gyms like Nautilus NS700X, German patent application DE19801672, US patent application 2006/0116249, and Cybex FT-450. Some exercise machines have the ability to use a straight bar, like U.S. Pat. Nos. 5,725,459 and 6,447,430; and the Body Craft PFT Functional trainer, along with several others. The problem with these is that while they do allow the ability to use a straight bar between the pull points, there is no easy way to move the pull points at the same time while leaving the bar attached. They use spring loaded lock pins which require a constant force to keep the pins retracted during adjustment of the pull points. And so for these gyms there is no easy way to adjust the vertical position of the pull points except to remove the bar.

Another problem with exercise machines is that during the performance of some of the pressing exercises or fly motion exercises, the path of travel for the exercise follows a predefined arc or guide-way. Such single plane motion eliminates or substantially reduces the amount of work that smaller secondary muscles would be required to do to balance the weight if the same exercise was being performed using free weights.

Some machines require extra time in selecting a resistance level, especially those that utilize progressive resistance means such as springs, elastic band resistance, or flexible members to provide the resistance. These means of resistance are generally not as preferred by serious athletes for muscle development, who instead prefer the constant resistance offered by free weights or stack weight machines. Many of the functional exercise machines have two weight stacks instead of one which more than doubles the time required to change resistance levels. If a machine takes a long time to be setup for different exercises and resistance settings, circuit training cannot be performed, and the workout is longer than it would otherwise need to be.

Another problem with existing exercise machines is that they detract from a room that is not specifically dedicated for exercise. Most exercise machines aren't designed to be hidden from view when not in use, which can be unsightly for a room that is not specifically dedicated to be a fitness room. Some gyms are designed to fold up when not in use to cut down on the space they take up, but they're often too heavy and/or bulky to move or store away from view. There are some home gyms that fold up and can be stored out of sight, perhaps under a bed. But these require substantial time and effort to unfold for a workout and then fold up again afterwards. In addition, these fold-up gyms often fail to provide a full body workout.

OBJECTS AND ADVANTAGES

The benefits of the invention relate to its versatility, compactness and functionality. A wide variety of exercises can be done on this one piece of equipment. As a result, additional exercise equipment is unnecessary. Various exercises can be performed with minimal changeover time which allows for the ability to do circuit training. The apparatus is designed to collapse into a space having a minimum depth. Thus, the apparatus is suitable for folding up into a cabinet, which allows the room to be used for other activities. Also, because of its compact size it could be shipped preassembled, freeing the buyer from this task and making it easy to take along during a move to a new home.

The ability of the arms to rotate both horizontally and vertically as well as translate vertically allows the cable ends at the ends of the arms to be positioned anywhere from near the ground to well overhead. The pulley assemblies at the ends of the arms allow the cables to exit freely and that feature along with the ability of the arms to freely rotate in the horizontal direction during exercising allows for a degree of instability during exercising which is balanced by the involvement of secondary muscles to balance the resistance. This helps to give the gym a feeling not dissimilar to working out with free weights. The horizontal movements of the arms also allow the arms to be better position for some exercise than if the arms were fixed parallel to one another. One example is while doing curls with the handgrips. The arms swivel in underneath where the handgrips are going through their motions and in that way gives a more natural feel to the exercise. Another example for this would be when doing flys or bench press exercises with the handgrips. The arms can also be locked into different positions of horizontal rotation (both inwardly and outwardly) in order to perform certain types of exercises. Like locking them all the way to their outmost positions for doing a crossover fly exercise.

The arms are able to move independently from one another in horizontal rotation (even during exercising) but they're tied together in vertical rotation and vertical translation. Because the arms are tied to move together in vertical rotation and vertical translation this allows an exercise bar to be left attached during repositioning the arms. The ability of the vertical rotation and vertical translation locks to remain in an unlocked position also aids in repositioning of the arms to new positions. Many gyms require a constant force to be exerted on their locking mechanisms for adjusting the guides (and arms) and so only one guide at a time is able to be repositioned by a single user. Because of this it would be difficult for a single user to reposition both guides at the same time while leaving a straight bar attached. For most gyms this isn't a problem because they aren't designed to use a straight bar. Even if the locks on other gyms could be locked in an open position, because the guides are not tied together in vertical translation (and if the gym also has arms attached to the guides these would need to be able to be tied together in rotation also) it would be difficult for a single user to reposition an attached straight bar to the same vertical (and rotational) positions. The means to engage the translation locks for both arms come to a single location and attaches to a single lever at the distal end of one arm and the means for engaging the vertical rotation locks for both arms also come to a single location and a single lever at the distal end of the other arm. This simplifies the movement of the arms by only needing to activate these two levers to release the arms in both vertical rotation and translation. And because of the levers' position and functionality, this allows the user a convenient place to hold onto the arms during arm repositioning. While tying the arms together (permanently in some embodiments) in vertical rotation and vertical translation does prevent the user from repositioning the arms at different heights and rotations relative to one another, the benefits of tying them together as outlined above outweighs this disadvantage. Many more exercises require the arms to be at the same height and vertical rotation than at different heights and/or rotations. Typically the user wants the two sides to be put into a mirror image to one another. So for each change of position without the above benefits the new location (both the vertical placement and vertical and horizontal rotation) would needs to be noted and remembered so that the other arm could be moved to the same location. Some exercises require the use of only one handgrip or leg strap which is not hindered by tying the arms together in vertical rotation and translation.

Additional benefits of the invention have to do with the cable reeving used in it. This reeving which is referred to as wrap-on wrap-off allows for a zero change in effective cable length (explained in more detail in the 'Operational Aspects' section below). This reeving helps to maintain a preload on the cable ends so that the bar doesn't slip during repositioning (important for some embodiments of the invention) and prevents movements of the selector bar at the weight stack. It allows for a different way to build a fixed arm variation as explained in the 'Additional Alternative Embodiments' section below. And it allows for the additional degree of freedom for the preferred embodiment, the ability for the arms to rotate in the horizontal direction (some of the benefits of which are as described above).

Other advantages will be apparent from the following description and drawings of several embodiments.

SUMMARY OF THE INVENTION

I have invented a versatile compact exercise apparatus. The exercise apparatus comprises the following: A pair of guide assemblies each comprising a guide and a rotating structure such that the guides are able to slide parallel to vertical axes and the rotating structures are able to rotate about them. A pair of arms that are rotationally attached to the guide assemblies at their pivot ends at horizontal axes that are substantially perpendicular to the vertical axes and have at their distal ends pulley assemblies which contain at least one pulley. A guide connection means for tying the guides together in vertical translation. A resistance assembly with a source of force and a selective means of engaging a portion of that force. And a cable assembly means for transferring forces from the resistance assembly to the cable ends that are located at the pulley assemblies at the distal ends of the arms.

I have also invented a versatile exercise apparatus comprising the following: A pair of guide assemblies each comprising a guide and a rotating structure such that the guides are able to slide parallel to vertical axes and the rotating structures are able to rotate about them. A guide connection means for tying the guides together in vertical translation. A resistance assembly with a source of force and a selective means of engaging a portion of that force. And a cable assembly means for transferring forces from the resistance assembly to the cable ends that are located adjacent to the rotating structures.

BRIEF DESCRIPTION OF THE DRAWINGS

The drawings are briefly described below.

For FIGS. 20-27 the nomenclature on the drawing is as follows: A: arm mounted; F: frame mounted; G: guide mounted; RS: rotating structure mounted; GC: guide connection mounted

DETAILED DESCRIPTION OF THE INVENTION

Figure 1:
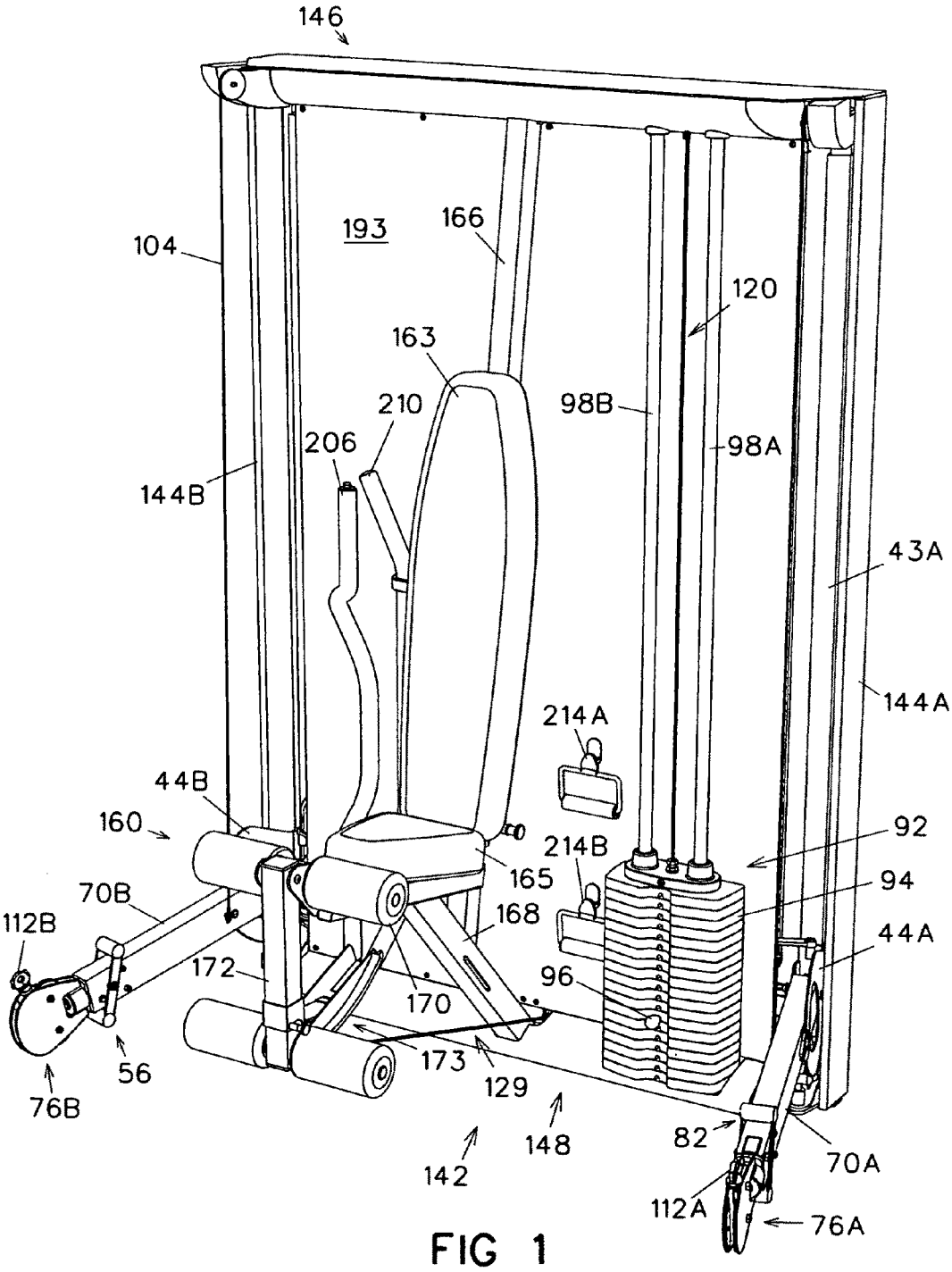
FIG. 1 is a right front perspective view of an exercise machine embodiment of the invention. The seat assembly is in the down position, the arms are in the bottom position and are both rotated outward.

A preferred embodiment of the present invention provides a multi-function exercise apparatus comprising: a pair of guide assemblies each comprised of a rotating structure and a guide which translates vertically within a wall mounted frame assembly; a pair of arms pivotally attached to the guide assemblies at their pivot end and having a rotating pulley assembly at their distal end each comprising at least one pulley; an arm connection means for tying the arms together in rotation; a resistance assembly comprised of a single weight stack; and a cable assembly means for transferring force from the resistance assembly to the cable ends located at the distal ends of the arms. The cable assembly means allows the arms and guide assemblies to rotate both vertically and horizontally and to translate vertically without effecting cable length by using a method of cable wrap called wrap-on wrap-off. Other components of the invention may include: a counterweight assembly to offset the weight of the arms and guide assemblies to make effortless their rotation and translation. In the preferred embodiment the counterweight along with a guide connection are used to tie the arms together in rotation; a seat assembly with leg extension; locking means for locking the arms in fixed vertical and horizontal rotation and for locking the guides in positions of vertical translation; and optionally a decorative cabinet for enclosing the entire exercise apparatus when not in use. The cabinet takes up a minimum of floor space. The following discussion will focus on structural elements and operational aspects.

Structural Elements

Various embodiments of the invention will be discussed to illustrate different aspects of the invention. It is understood that embodiments may include some or all of the components and features discussed below. While many of the figures are of different embodiments, the following discussion will be as though most are of one embodiment.

Overviews of the major components that can comprise one or more embodiments of an exercise apparatus of the invention are listed below. Later in the description more detail is given to each of the components. The major components of the exercise apparatus of these embodiments include: a pair of arms 70A,70B—(FIGS. 2,3) that are pivotally attached to a pair of guide assemblies 40A,40B comprised of a rotating structures 43A,43B and guides 44A,44B; a guide connection means 41 ties the guides 44A,44B together in vertical translation; a resistance assembly 92; a cable assembly means 108, that includes an arm cable assembly 110, a resistance cable assembly 120 and a leg extension cable assembly 129; a frame assembly 142 (FIG. 1); a counterweight assembly 100 (FIG. 2); a vertical rotation lock means 82 (FIG. 3); a translation lock means 56; an optional seat assembly 160 (FIG. 1); an optional cabinet enclosure 191 (FIG. 42); and an assortment of user interfaces.

Figure 2:
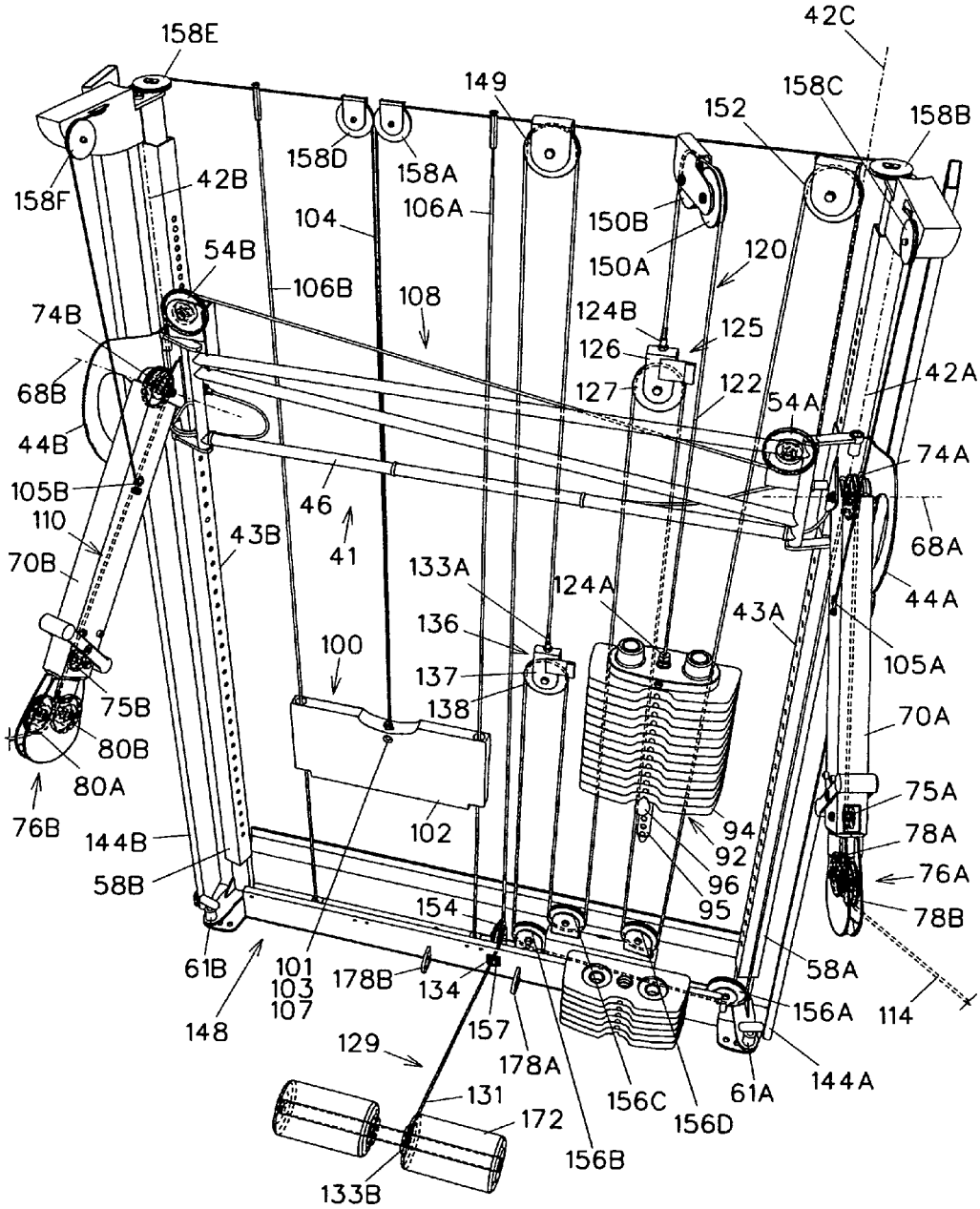
FIG. 2 is a front/side perspective view of the preferred embodiment showing the arms rotated down and out with the top frame assembly, seat assembly, and back panel removed for clarity. The figure shows the cable assembly means of transferring forces, the resistance assembly and the counterweight assembly.
Figure 13:
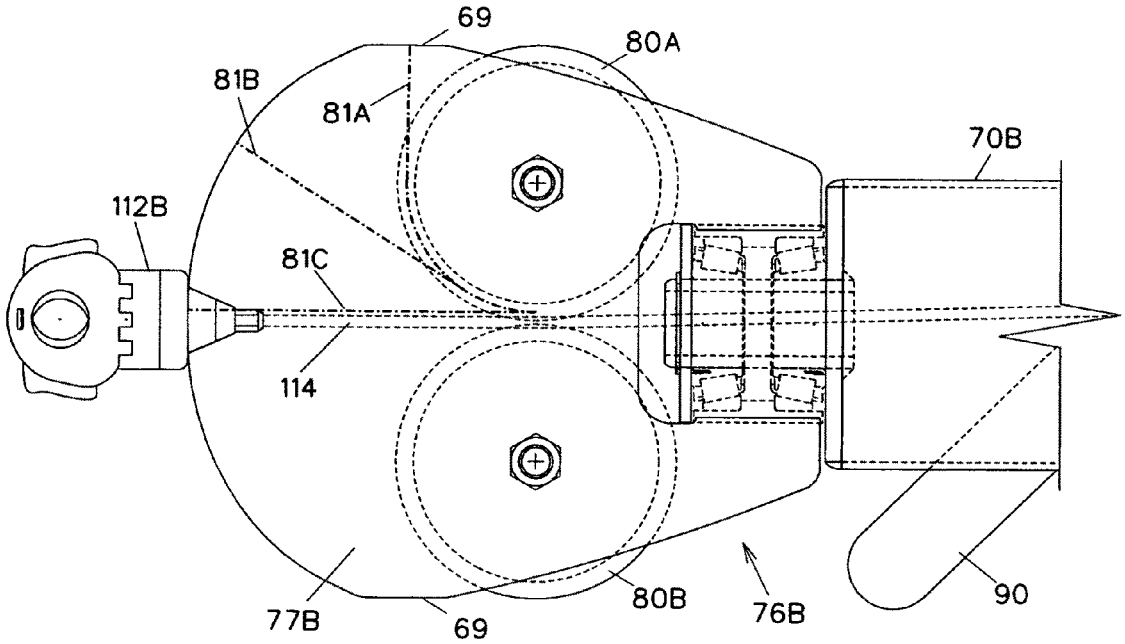
FIG. 13 is a right side view of the pulley assembly at the distal end of the left arm.
Figure 14:
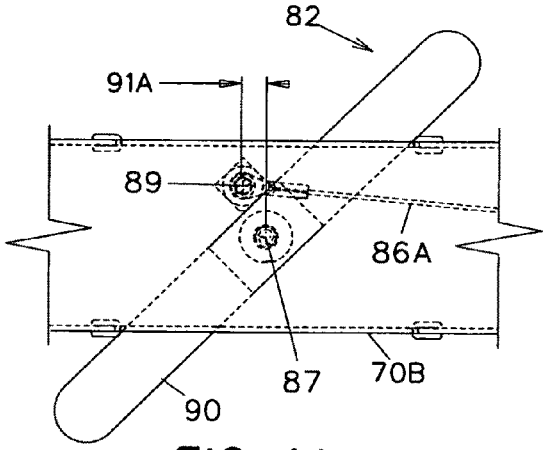
FIG. 14 is a right side view of the activation lever of the left arm positioned so that the lock pin assemblies are engaged.
Figure 15:
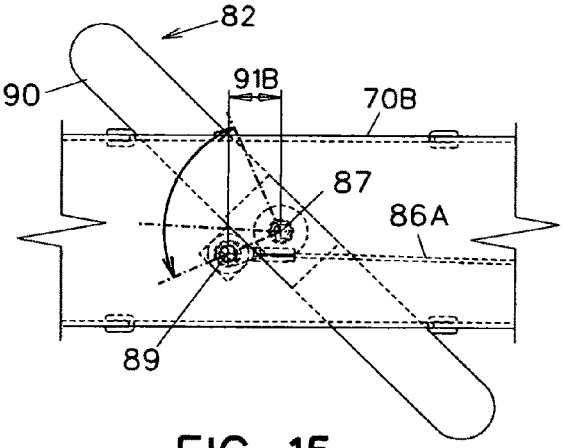
FIG. 15 is a right side view of the activation lever of the left arm positioned so that the lock pin assemblies are disengaged.
Figure 34:
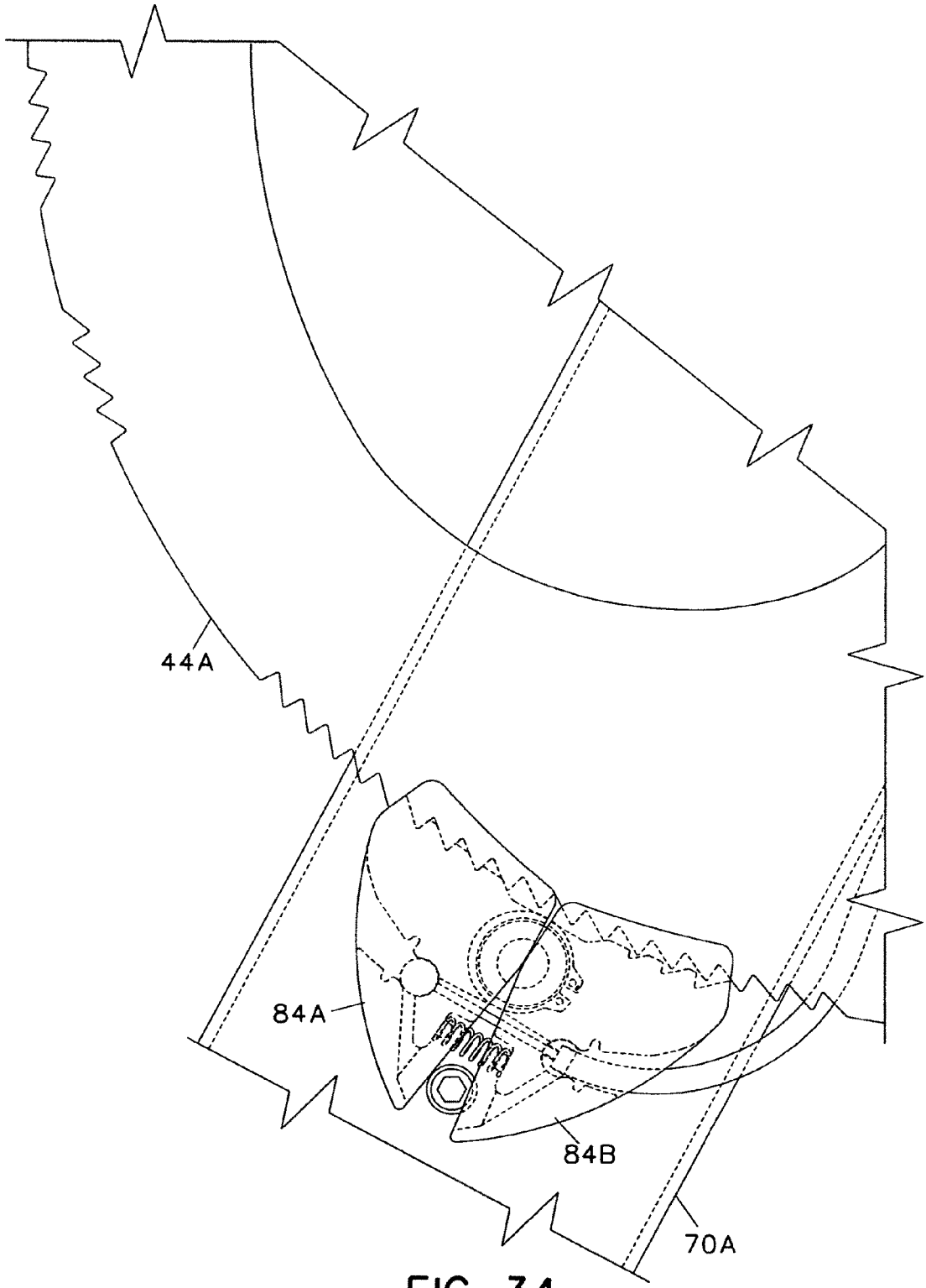
FIG. 34 shows a right side view of the ratchet bars of the right arm that are engaged in the right arm guide locking the arm from clockwise rotation.
Figure 35:
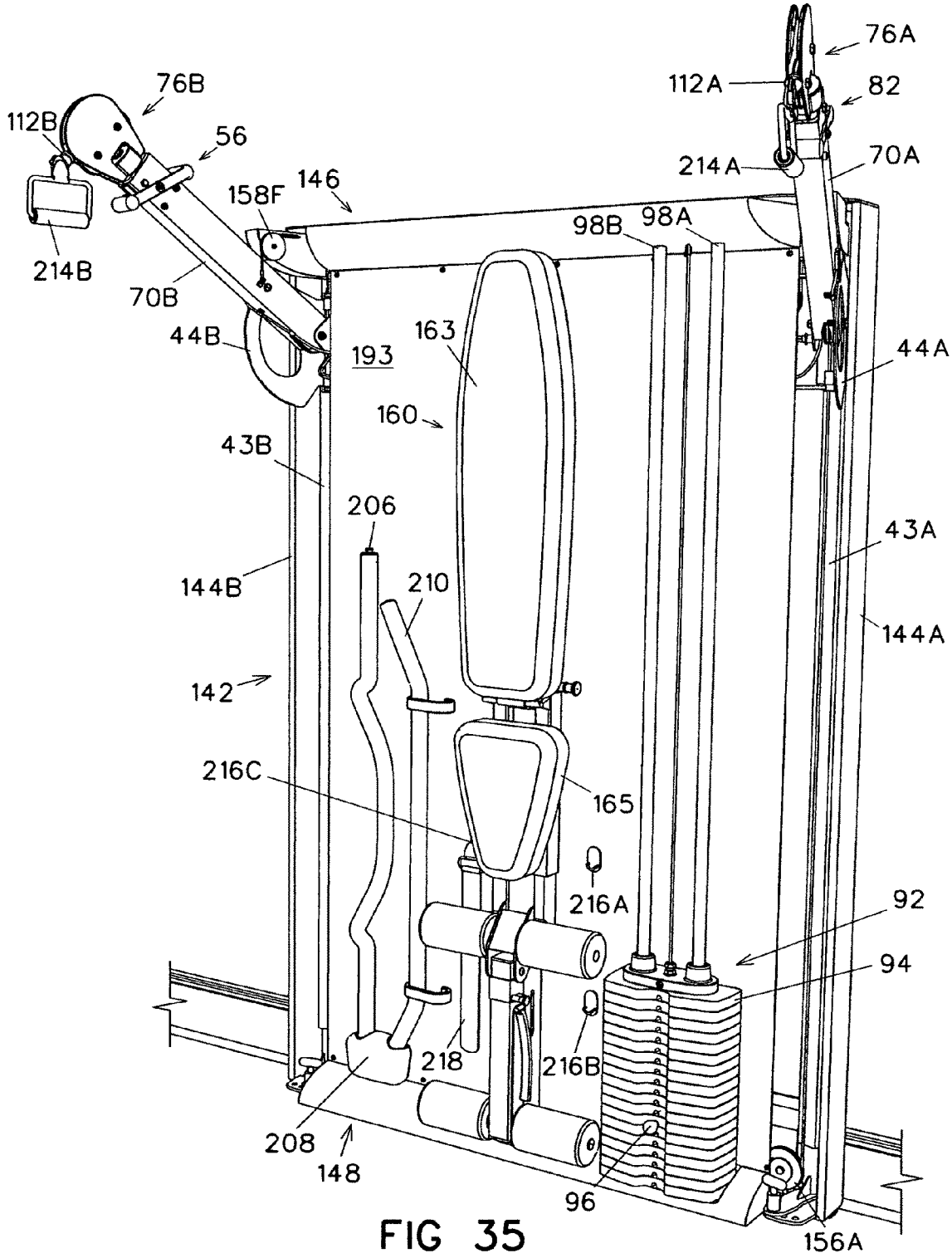
FIG. 35 shows a right front perspective view of the exercise machine with the arms raised all the way up and out and with the seat in the closed position.
Figure 36:
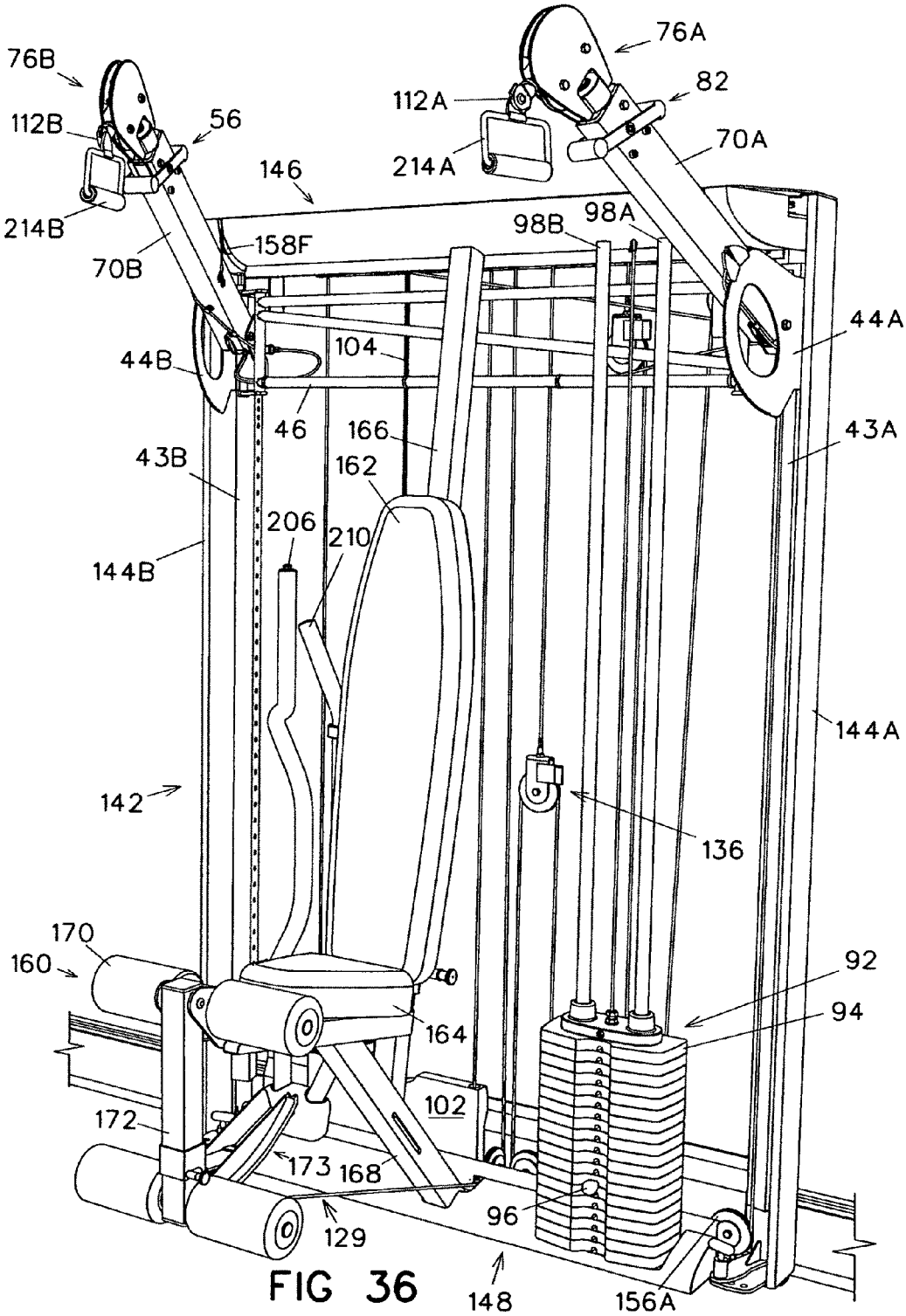
FIG. 36 shows a right front perspective view of the exercise machine with the arms raised all the way up and in and with the seat in the open position with the back panel removed to show the cable reeving.

The preferred embodiment of the exercise apparatus is shown in FIG. 1 and in FIG. 35. The arms 70A,70B have a pivot end and a distal end. The arms 70A,70B are rotationally attached at their pivot end to the guides 44A,44B at pivot pins 45A,45B (FIG. 3) and these two pivot pins define the horizontal axes 68A,68B (FIG. 2). Near the pivot end of arm 70A, pulley 74A is rotationally attached to pivot pin 45A and likewise near the pivot end of arm 70B pulley 74B is rotationally attached to pivot pin 45B. Pulley 74A is substantially the same size and shape as pulley 74B. At the distal ends of the arms 70A,70B are mounted pulley assemblies 76A,76B (FIGS. 3,13) that are comprised of a pulley structure 77A, 77B rotationally attached substantially at the centerline of the arms 70A,70B; a sets of pulleys, 78A, 78B and 80A, 80B, positioned so that they are nearly touching, such that they keep captive any cable passing between them. The shape of the pulley structure 77A, 77B (FIG. 13) is designed such that preferably the length of any cable coming from between the pulleys 78A,78B,80A,80B to a cable end 112A,112B is substantially the same length regardless of where cable end 112A,112B is positioned and so the length of cable segment 81A (FIG. 13) is substantially equal to the length of cable segments 81B and 81C. At the top and bottom of pulley structure 77A,77B is flat spot 69 that causes the constant length of the cable segments described above to deviate slightly. It increases the length of the cable segments slightly before the flat spot 69 and after it thereby providing an area that the cable ends 112A,112B can rest that provides some resistance to sliding relative to the pulley structure 77A,77B. Vertical rotation lock means 82 (FIG. 14) provides a way to lock the vertical rotation of the arms 70A,70B relative to the guides 44A,44B for different exercises and for storage. The vertical rotation lock means 82 is comprised of ratchet bars 84A, 84B, 84C, 84D (FIGS. 28,34) that are spring loaded and are located on the arms 70A,70B near their pivot ends. These ratchet bars are in communication with an activation lever 90 (FIGS. 14,15) near the distal end of arm 70A, at an attachment point 89. As the activation lever 90 is rotated, attachment point 89 rotates to two different positions that are on opposite sides of pivot 87 and that are different distances 91A, 91B from pivot 87. When the activation lever 90 is positioned so that there is a distance 91B, then ratchet bars 84A, 84B, 84C, 84D are retracted and when the activation lever is positioned so that there is a distance 91A then the ratchet bars are allowed to extend and engage a plurality of teeth on guides 44A, 44B (FIG. 34), which allows the arms 70A,70B to be locked in rotation relative to the guides 44A,44B in a number of useful locations.

Figure 6:
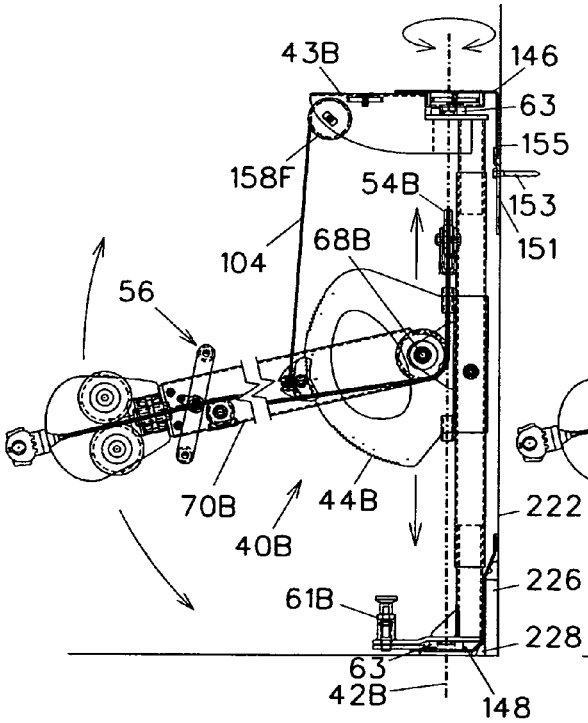
FIG. 6 is a section view from FIG. 5 that shows the right side view perspective of the preferred embodiment showing the left arm and the left guide assembly.
Figure 7:
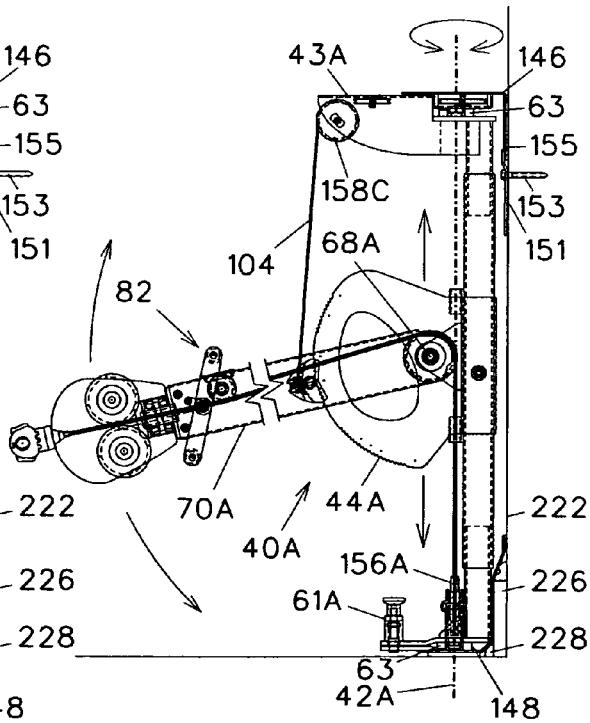
FIG. 7 is a section view from FIG. 5 that shows the right side view perspective of the preferred embodiment showing the right arm and the right guide assembly.

Guide assemblies 40A,40B (FIGS. 3, 5-7) are comprised of guides 44A, 44B and rotating structures 43A,43B. In the preferred embodiment the arms 70A,70B are rotationally attached to the guides 44A,44B at horizontal axes 68A,68B. Pulleys 74A,74B are also rotationally attached to horizontal axes 68A,68B. The relative position of the arms 70A,70B and guides 44A,44B relative to the vertical axes 42A,42B is defined such that the effective circumference (circumference at the pitch diameter of the pulley) of pulley 74A,74B is substantially tangent to the vertical axes 42A,42B. This allows the arms 70A,70B and guide assemblies 40A,40B to rotate horizontally about the vertical axes 42A,42B without changing the effective cable length of the arm cables. The guides 44A,44B are slideably attached to vertical square tubing 58A,58B (FIG. 2) of the rotating structures 43A,43B. Because a square tube in a square tube arrangement is used, the guides 44A,44B cannot rotate around the centerline of the vertical square tubing 58A,58B of the rotating structures 43A,43B but can slide along it's length. The rotating structures 43A,43B is rotationally mounted at their top side to top frame assembly 146 at bearing 63 (FIGS. 6,7) and rotationally mounted at their bottom side to bottom frame assembly 148 at bearing 63. These bearings define the vertical axes 42A,42B that rotating structures 43A,43B rotate about. This arrangement allows the rotating structures 43A,43B, guides 44A,44B and arms 70A,70B to all rotate about the vertical axes 42A,42B while preserving the substantial tangency of the pulleys 74A,74B effective circumference to the vertical axes 42A,42B. Translation lock means 56 (FIGS. 3,4) provides a way to lock the guides 44A,44B to the vertical square tubing 58A,58B. The translation lock means 56 is comprised of lock pin assemblies 65A, 65B (FIGS. 3,4), that are spring loaded pins located on the guides 44A, 44B, and are connected via cables 60A,60B to an activation lever 64 near the distal end of the left arm 70B. The rotation of activation lever 64 is similar to the rotation of activation lever 90 described above. When the activation lever 64 is rotated it retracts or extends the lock pin assemblies 65A,65B thereby locking the guides 44A, 44B to vertical square tubing 58A,58B, which have a plurality of holes located in them. Lockable lock pins 61A,61B (FIGS. 2,3) located near the bottom of the rotating structures 43A,43B allow the rotating structures 43A,43B (and therefore the arms) to be locked into different angles of horizontal rotation relative to the frame assembly 142 (FIG. 1). The lockable lock pins 61A,61B stay in the unlocked position by a quarter turn of the lockable lock pins 61A,61B and are spring loaded when turned to the locking position.

Figure 20:
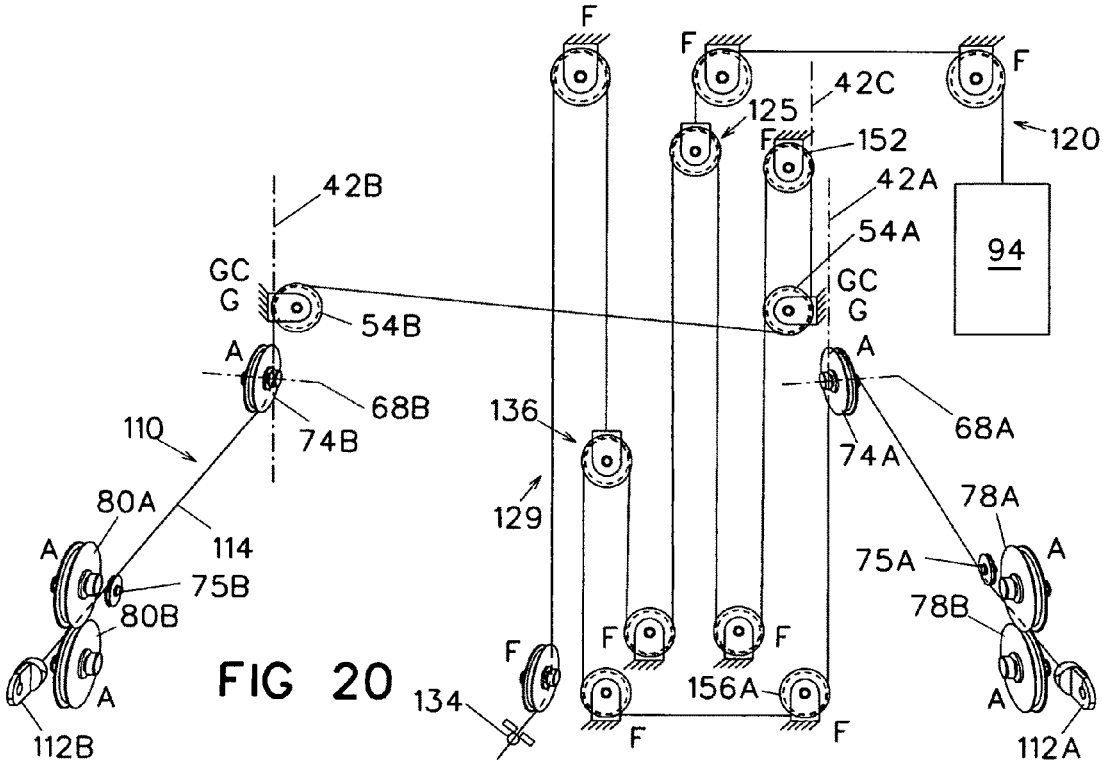
FIG. 20 is a schematic representation of the preferred embodiment cable reeving of FIG. 2.
Figure 22:
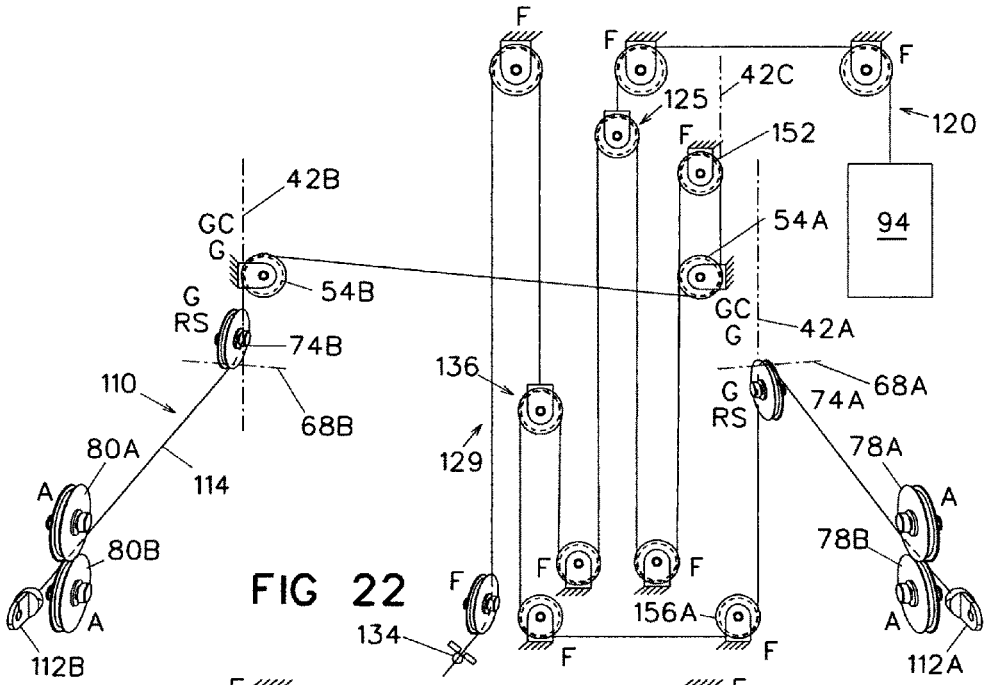
FIG. 22 is a schematic representation of an alternative cable reeving method that shifts the pulleys that were on the pivots of the arms off of the pivots of the arms.

The guide connection means 41 (FIG. 2) for the preferred embodiment comprises a guide connection 46 and the counterweight assembly 100. The guide connection 46 is a rigid structure which mounts rotationally to the guides 44A,44B at the vertical axes 42A,42B. Since the guides 44A,44B rotate about the vertical axes 42A,42B there is substantially no change in position for the guide connection 46 during horizontal rotation of the arms 70A,70B and guide assemblies 40A,40B. The use of the guide connection 46 allows for a less rigid arm connection by using the counterweight assembly 100 to insure that the arms 70A,70B rotate at the same time and angle. In the preferred embodiment the guide connection 46 is also used to mount pulleys 54A,54B, which are used to move the arm cable 114 from traveling vertically along vertical axis 42B to a vertical axis 42C (FIG. 2) which has a closer proximity to vertical axis 42A. The reason for this change in vertical cable position is so that there is less of an overturning moment on the guides 44A,44B if during use the translation lock means 56 is not engaged. This cable repositioning is explained in the 'operational aspects' section below and shown in (FIGS. 2,20,22). Pulley 54B is mounted to guide connection 46 so that the effective circumference of pulley 54B is substantially tangent to the vertical axis 42B. Pulley 54A is mounted to guide connection 46 so that the effective circumference of pulley 54A is substantially tangent to vertical axis 42C.

Figure 26:
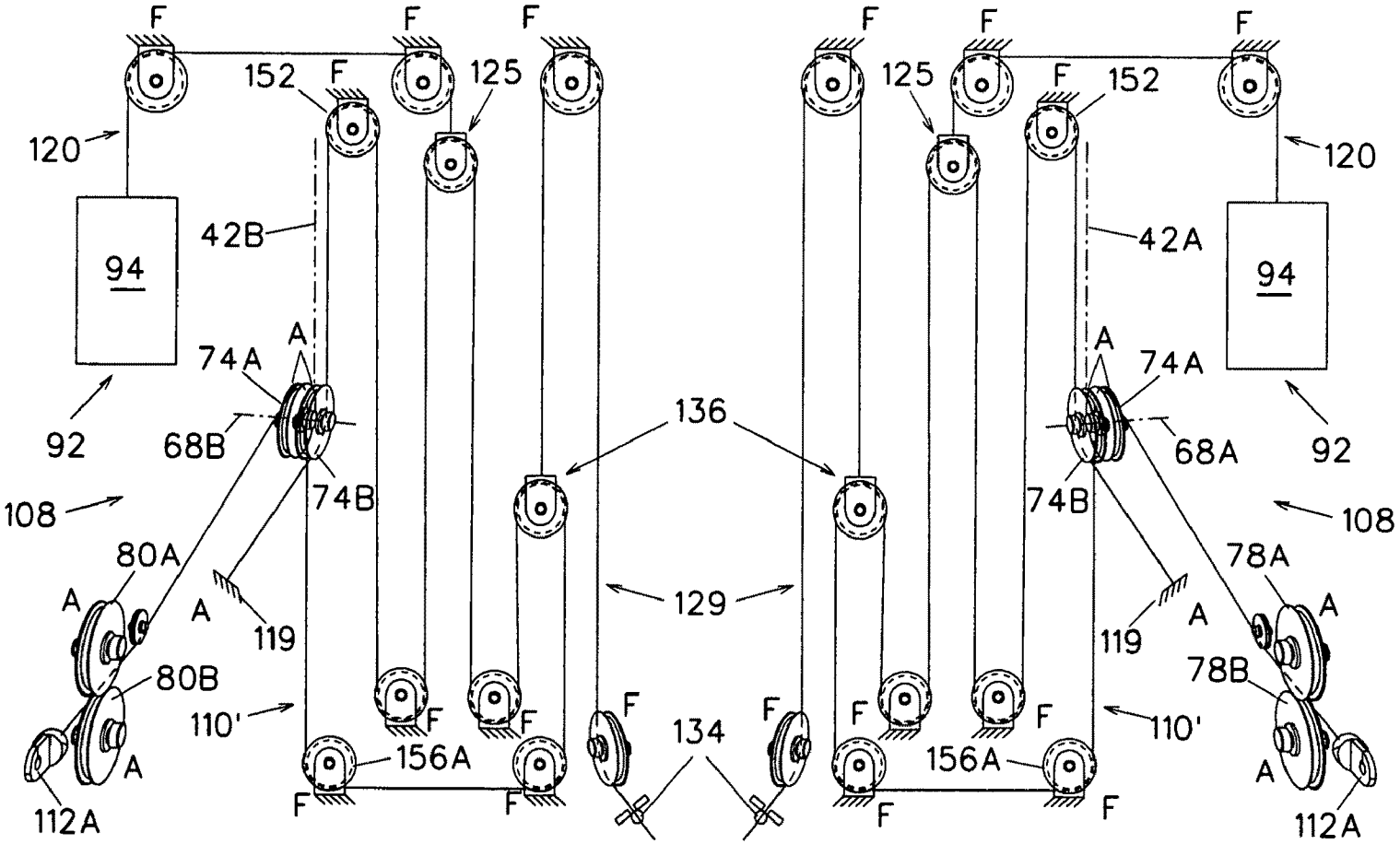
FIG. 26 is a schematic representation of an alternative embodiment that has two single arm arrangements mounted next to one another with the pulleys near the pivots of the arms on the pivot of the arms.
Figure 27:
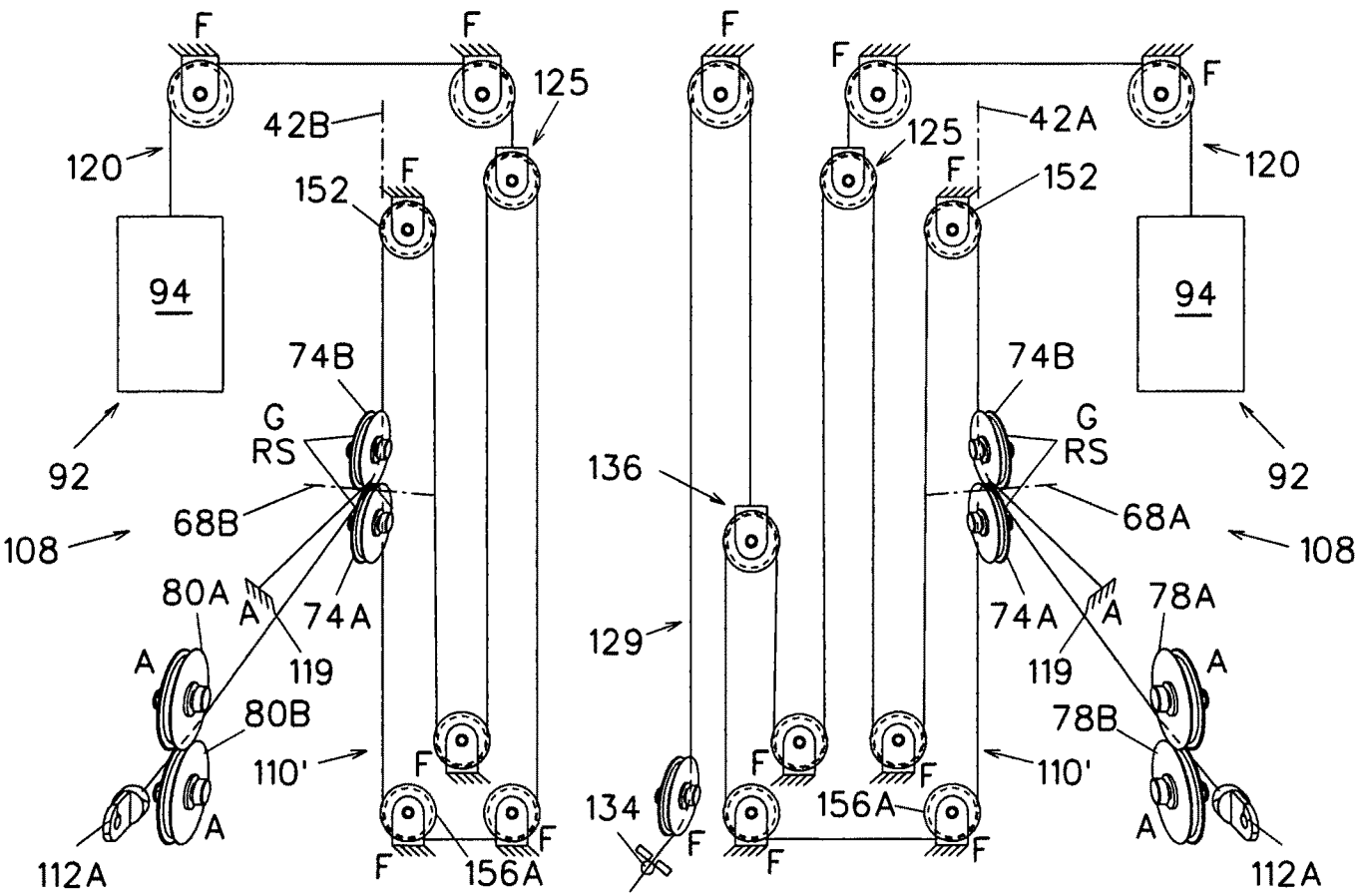
FIG. 27 is a schematic representation of an alternative embodiment that has two single arm arrangements mounted next to one another and that shifts the pulleys that were on the pivot of the arms off of the pivots of the arms, and also removes the leg extension pulley arrangements from the left arm.

The resistance assembly 92 (FIG. 2) provides the resistance and for the preferred embodiment is comprised of a weight stack 94, a selector bar 95 that fits down through the center of the weight stack, a selector pin 96 that is able to engage a plurality of holes in the selector bar, and guide bars 98A and 98B, which confine and guide the weight stack. Guide bars 98A, 98B are mounted at their top end to the top frame assembly 146 and at their bottom end to bottom frame assembly 148. Alternatively two weight stacks can be used if the cable assembly means is arranged in a similar fashion to that as shown in (FIGS. 26,27). Alternatively, another source of force may be used instead of weight stacks such as those having non-gravity based resistance elements like those known to the art.

The cable assembly means 108 (FIG. 2) is for transferring the resistance selected at the resistance assembly 92 to cable ends 112A and 112B that extend from the distal ends of the arms 70A,70B and to a cable end 133B located at a leg extension 172. The cable assembly means 108 is comprised of a resistance cable assembly 120 that communicates the resistance from the resistance assembly 92 through a resistance block assembly 125 to an arm cable assembly 110, which then communicates the resistance through a leg extension block assembly 136 to a leg extension cable assembly 129. The resistance cable assembly 120 is comprised of a resistance cable 122 that has a cable end 124A, which is in communication with resistance assembly 92, at one end, and a cable end 124B fastened to the top side of the resistance block assembly 125 at the other end. The resistance block assembly 125 has a top side and a bottom side and is comprised of a block bracket 126 and a pulley 127 located at it's bottom side. The resistance block assembly 125 is in communication with the resistance assembly 92 by way of the resistance cable assembly 120 connected at it's top side and transfers this resistance to arm cable assembly 110 which is in communication with the pulley 127 located at it's bottom side. The arm cable assembly 110 transmits this resistance to cable ends 112A, 112B (FIG. 1) located at the distal ends of the arms 70A,70B and to leg extension cable assembly 129 via the leg extension cable block assembly 136 that it is in communication with. The leg extension cable block assembly 136 has a top side and a bottom side and is comprised of a pulley 138 and a block bracket 137. Pulley 138 is located on the bottom side of leg extension block assembly 136 and is in communication with arm cable assembly 110 that is also in communication with resistance assembly 92 as described above. Leg extension cable assembly 129 is comprised of a leg extension cable 131, cable ends 133A, 133B, and cable stop 134. Cable end 133A is fastened to the top side of leg extension block assembly 136, to bracket 137, and the other cable end 133B of leg extension cable assembly 129 is pivotally connected to leg extension 172. A cable stop 134 located on leg extension cable 131 between cable ends 133A, 133B engages a stop bracket 157 located on the bottom frame assembly 148 so that cable stop 134 will not retract past the stop bracket 157.

Figure 3:
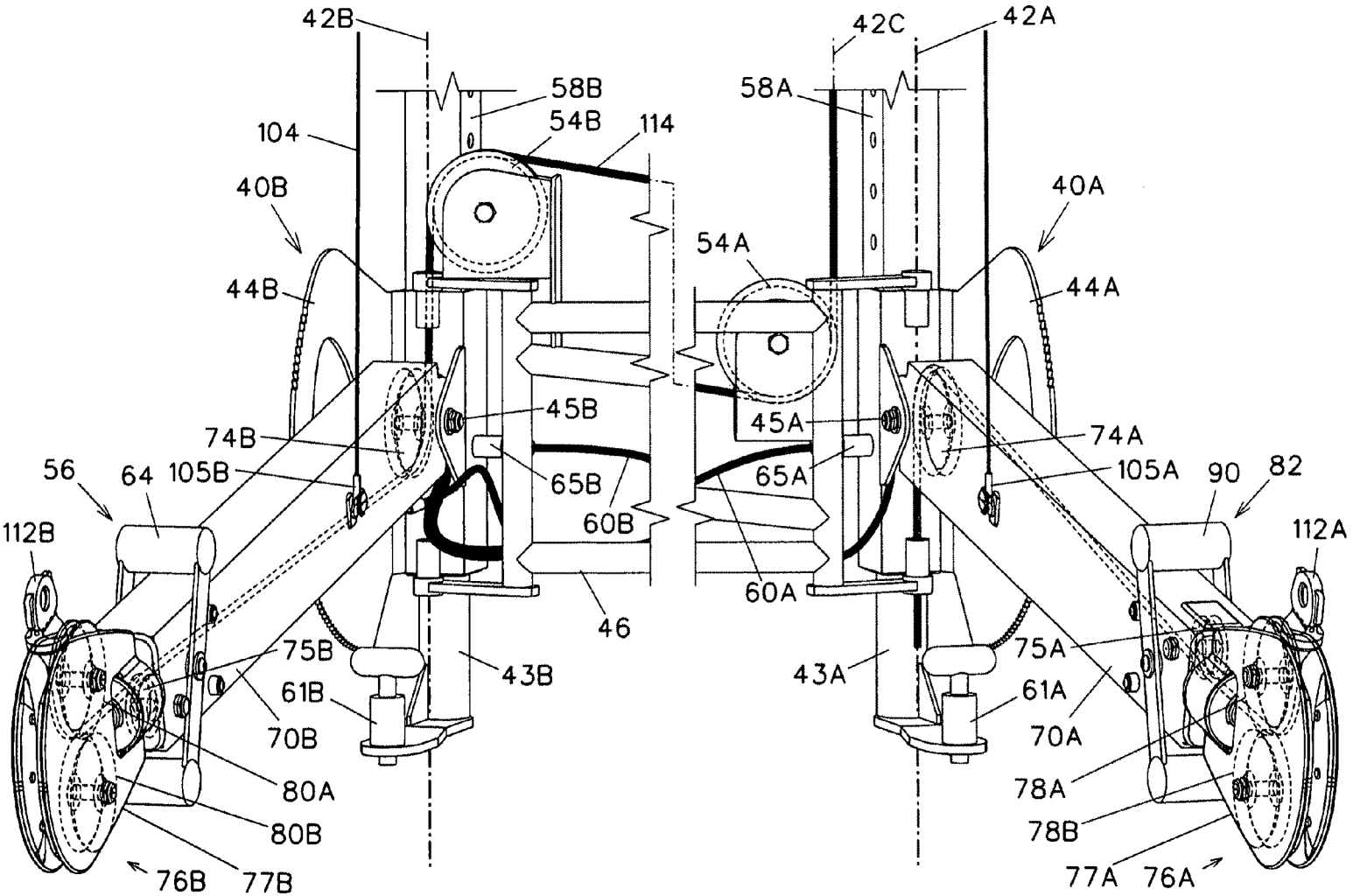
FIG. 3 is a front/top perspective view of an embodiment showing the arms, guide assemblies and guide connection, along with means for locking the arms in vertical and horizontal rotation and the guides in translation.
Figure 4:
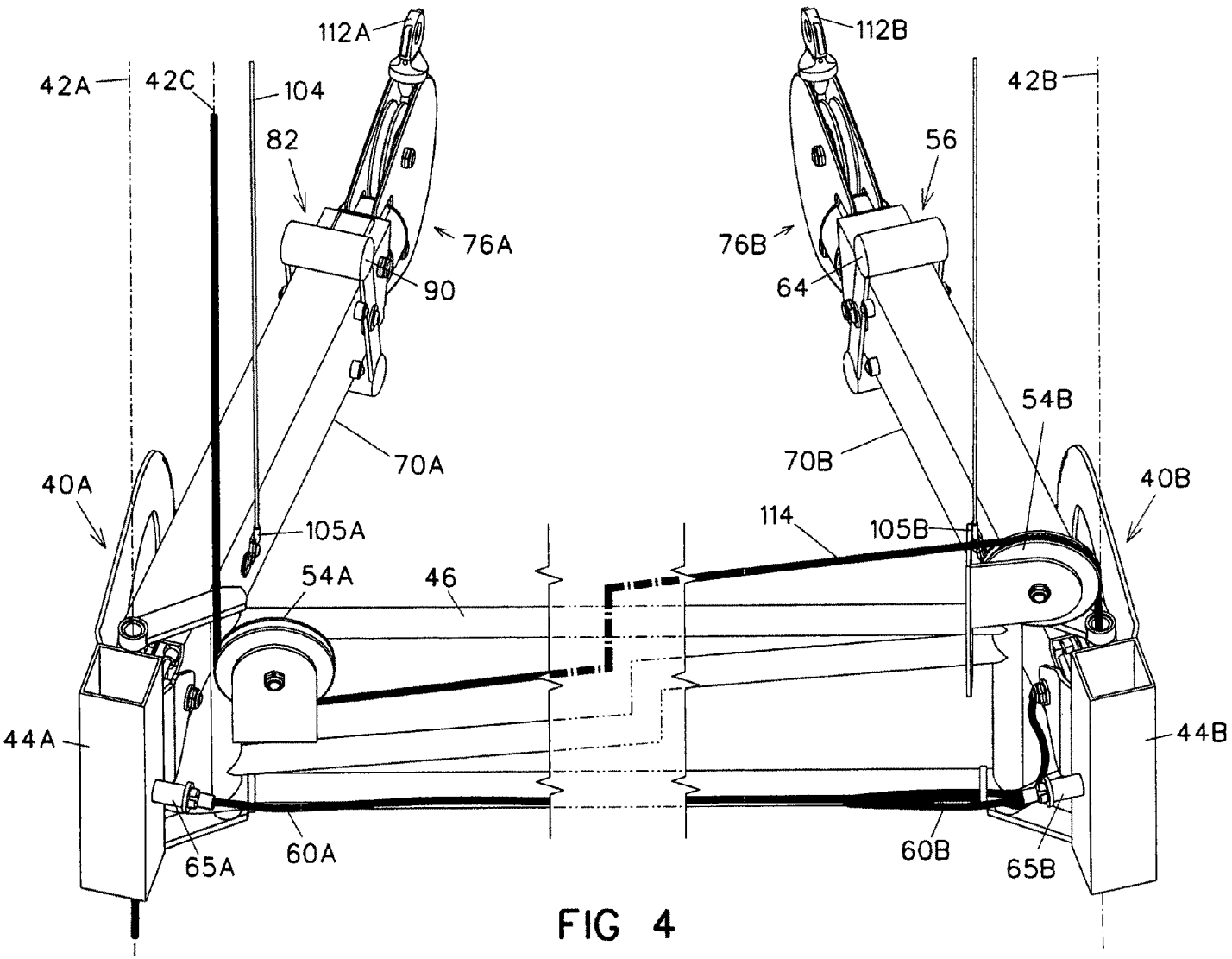
FIG. 4 is a rear/top perspective view of an embodiment of the arms and guides.
Figure 5:
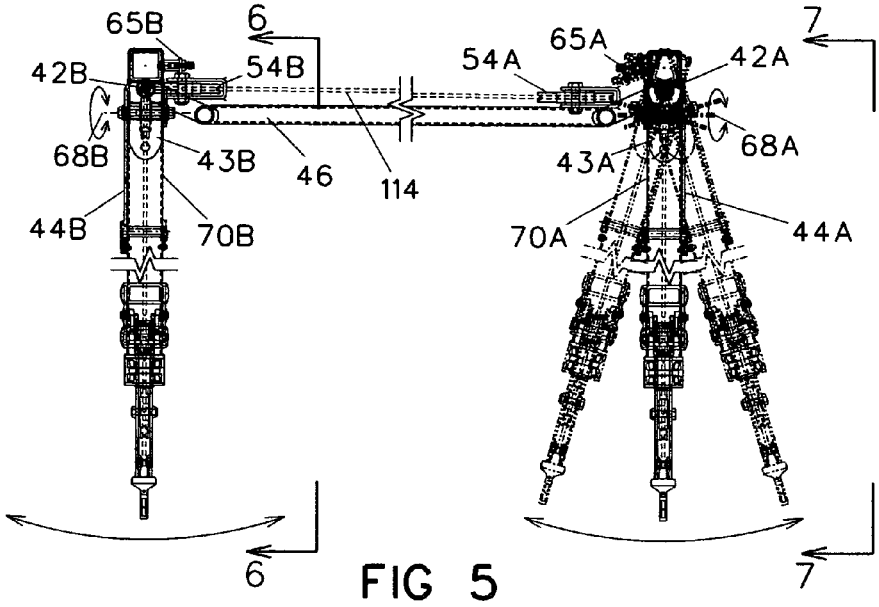
FIG. 5 is a top view perspective of the preferred embodiment showing the arms and guide assemblies and the horizontal range of motion.

Arm cable assembly 110 (FIG. 2) is comprised of an arm cable 114 with cable ends 112A, 112B. The cable ends 112A, 112B are designed as stops so that they cannot retract past the pulley assemblies 76A, 76B and back into the arms 70A,70B. Following arm cable 114 as it emerges from cable ends 112A at the distal end of arm 70A. First arm cable 114 passes between the pulleys 78A, 78B of pulley assembly 76A, through the inside of arm 70A, and then passes over a guide pulley 75A (FIG. 3). Guide pulley 75A is used on the preferred embodiment but may not be needed on alternative embodiments. Guide pulley 75A directs the arm cable 114 to pulley 74A which is positioned such that its effective circumference is substantially tangent to the vertical axis 42A. Arm cable 114 exits pulley 74A running down and substantially collinear to vertical axis 42A where it wraps onto a pulley 156A located in bottom frame assembly and whose effective circumference is substantially tangent to the vertical axis 42A. Arm cable 114 wraps over and exits pulley 156A and wraps onto a pulley 156B (FIG. 2), which is substantially in the same plane as pulley 156A, and exits running vertically along a path that is substantially parallel with the vertical axis 42A where it then wraps over pulley 138 of leg extension block assembly 136 and exits pulley 138 after approximately 180 degrees of wrap, running vertically down along a path that is substantially parallel with the vertical axis 42A. Here arm cable 114 wraps onto a pulley 156C located in bottom frame assembly 148, wraps approximately 180 degrees around pulley 156C and exits running vertically up along a path that is substantially parallel with the vertical axis 42A, where it then wraps over pulley 127 of resistance block assembly 125 and exits pulley 127 after approximately 180 degrees of wrap. It runs vertically down along a path that is substantially parallel with the vertical axis 42A. Arm cable 114 then wraps onto a pulley 156D located in bottom frame assembly 148, wraps around pulley 156D and exits to run up to a pulley 152 in top frame assembly 146 which is substantially in the same plane as pulley 156D and is located so that after arm cable 114 wraps over the top and exits pulley 152 and runs down vertically along a vertical axis 42C which is substantially parallel to vertical axis 42A and wraps onto pulley 54A mounted on guide connection 46. Arm cable 114 wraps over pulley 54A, exits and wraps onto pulley 54B which is substantially in the same plane as pulley 54A and the plane of 54B substantially contains vertical axis 42B. Also the effective circumference of 54B is substantially tangent to vertical axis 42B so that as arm cable 114 exits pulley 54B down to pulley 74B it follows a path that is approximately collinear to vertical axis 42B. Arm cable 114 wraps onto pulley 74B, located at the pivot end of arm 70B, whose effective circumference is also substantially tangent to vertical axis 42B. After arm cable 114 wraps around pulley 74B it runs inside of arm 70B, and passes over guide pulley 75B (used on the preferred embodiment but may not be needed on other embodiments) which directs arm cable 114 to run approximately down the rotational centerline of pulley assembly 76B. It then passes between pulleys 80A, 80B of pulley assembly 76B and terminates at cable end 112B.

Resistance cable assembly 120 (FIG. 2) is comprised of resistance cable 122, with a cable end 124A that bolts into selector bar 95 at the resistance assembly 92, and a cable end 124B that bolts onto the top side of resistance block assembly 125. Following the resistance cable 122 as it emerges from cable end 124A at the resistance assembly 92, resistance cable 122 goes straight up along a path substantially parallel to vertical axis 42A, to a pulley 150A whose effective circumference is substantially tangent to the path of resistance cable 122 and is positioned in the top frame assembly 146. Resistance cable 122 exits pulley 150A and wraps onto a pulley 150B located in the same plane as pulley 150A and whose effective circumference is located substantially tangent to a vertical line which runs through the centerline of resistance block assembly 125 and runs substantially parallel to the vertical axis 42A. Resistance cable 122, upon exiting pulley 150B, runs along this centerline where it then terminates at cable end 124B, which is bolted to the top side of and centerline of resistance block assembly 125.

Leg extension cable assembly 129 (FIG. 2) is comprised of leg extension cable 131, a cable end 133A that bolts onto the top and centerline of leg extension block assembly 136, a cable end 133B pivotally connected to leg extension 172, and a cable stop 134. Following the leg extension cable 131 as it emerges from cable end 133A at the top side of leg extension block assembly 136, leg extension cable 131 goes straight up along the center line of leg extension block assembly 136 and substantially parallel to vertical axis 42A, to a pulley 149 whose effective circumference is located substantially tangent to the current path of leg extension cable 131, and positioned in the top frame assembly 146. Leg extension cable 131 wraps over pulley 149 and exits straight down a path substantially parallel with vertical axis 42 to pulley 154 located in bottom frame assembly 148. Pulley 154 is located so that the plane defined by the leg extension cable 131 and it enters and exits pulley 154 is substantially parallel with the plane that leg extension 172 operates in as it rotates about its pivot located on a thigh support 170. Shortly after exiting pulley 154, leg extension cable 131 has a cable stop 134 attached to it, which prevents the cable stop 134 and cable from retracting back past a stop bracket 157 located in bottom frame assembly 148. From here leg extension cable 131 travels out to and terminates at cable end 133B that is pivotally connected to leg extension 172.

Figure 38:
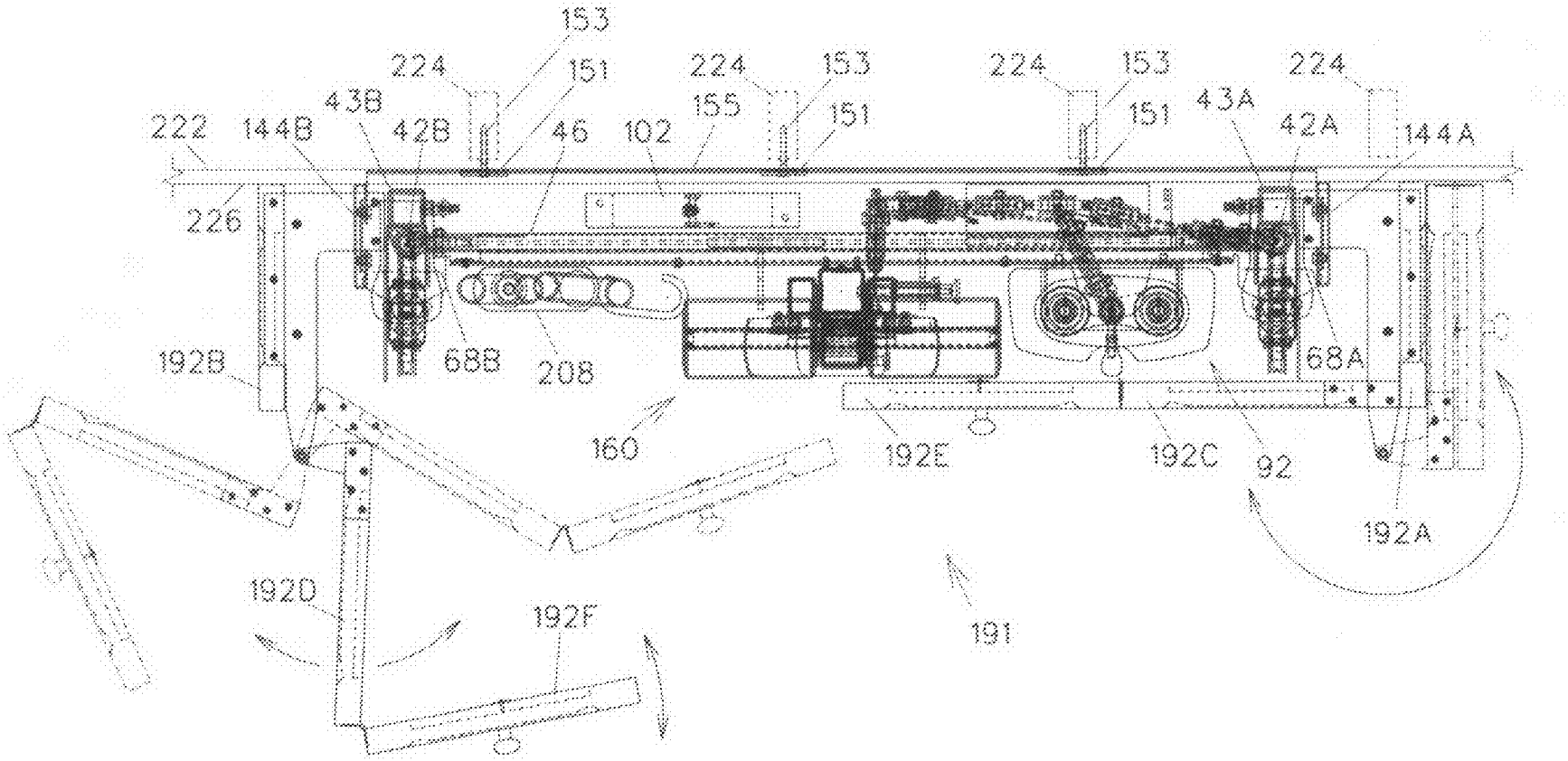
FIG. 38 is a top view of the exercise machine mounted to the wall with the optional cabinet enclosure installed and shows how the cabinet doors open and close.

Frame assembly 142 (FIG. 1) is comprised of right member 144A, and left member 144B that are bolted at their bottoms to bottom frame assembly 148, and bolted at their tops to top frame assembly 146. This creates a structurally solid frame where frame elements 144A and 144B run substantially parallel to one another. Top frame assembly 146 is the part of the frame assembly 142 that can come in contact with a wall 222 (FIGS. 6,7,38), specifically at wall rest 155. To mount the frame assembly 142 to the wall 222, first locate wall studs 224 and mark their centerlines at the correct height above the ground. The frame assembly 142 is positioned up against the wall 222 and then mounting brackets 151 are positioned over the wall studs 224 while lag bolts 153 are installed through the mounting brackets 151 into the wall studs, thus securing frame assembly 142 to the wall 222. In an alternative design the bottom frame also contacts the wall with a wall rest and can also be secured to the wall with mounting brackets.

Counterweight assembly 100 (FIG. 2) offsets the combined weight of the arms 70A,70B, guides 44A,44B, guide connection 46 and an exercise bar 206 to allow for easier rotation and vertical translation. In one embodiment, the counter weight assembly 100 is comprised of a counter weight cable 104 that is pivotally connected to the arms 70A,70B at pivots 105A, 105B (which are located at the approximate combined center of gravity of the arms 70A, 70B, guides 44A,44B, guide connection 46 and exercise bar 206). From the pivots 105A, 105B the counter weight cable 104 goes up to the top frame assembly 146 where it wraps over pulleys 158(A-F) before coming down and pivotally attaching to a counter weight 102 by way of a thimble 101, a wire clamp 103 and a bolt 107. The vertical travel of counterweight 102 is guided by counterweight guides 106A,106B.

Figure 16:
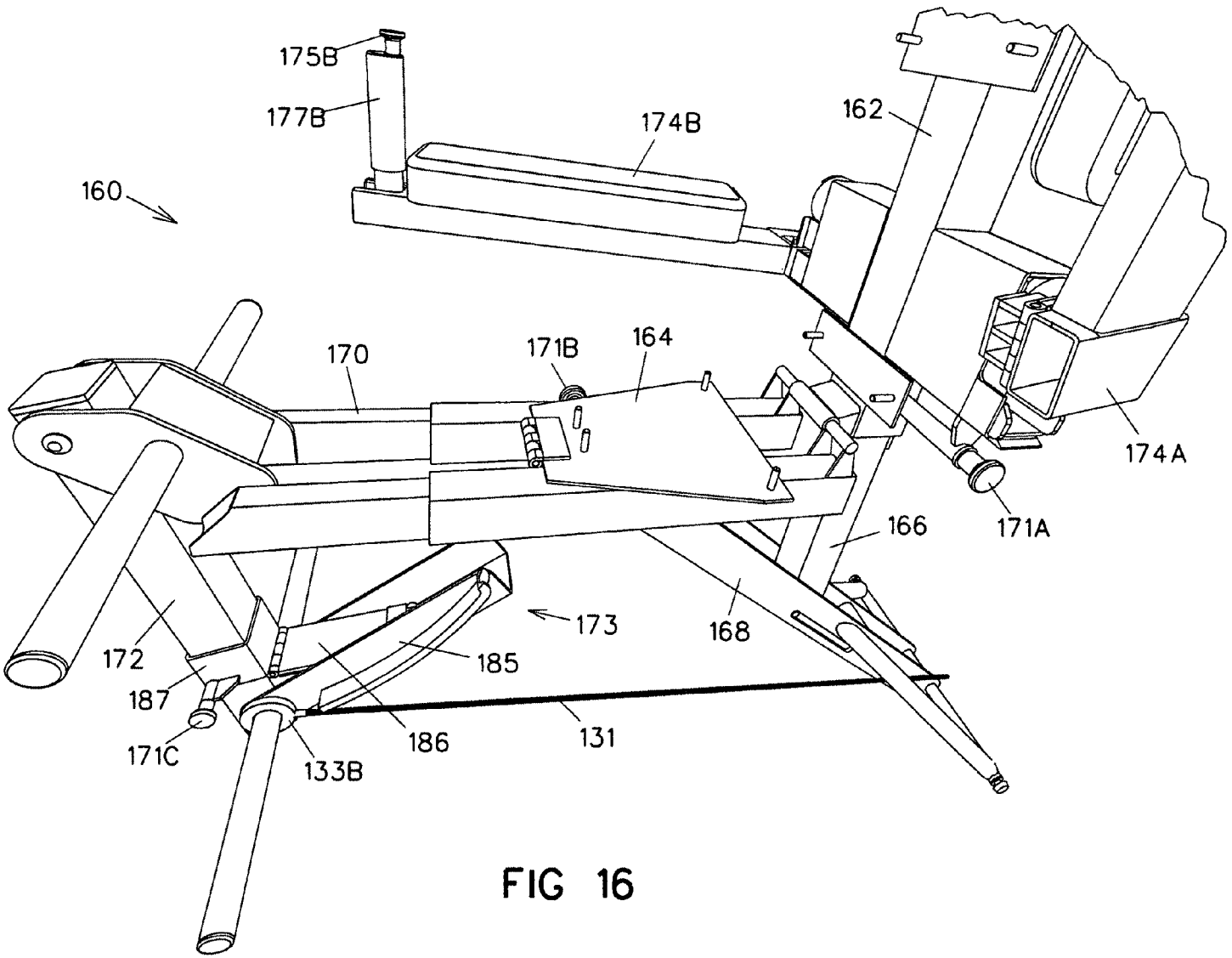
FIG. 16 is a right front perspective view of an embodiment of the seat assembly in its folded out position with the seat pad, backrest pad, thigh cushions, and ankle cushions removed for clarity. One of the Roman chair arms is down and the grip for that arm is shown in its raised position.
Figures 17, 18, 19:
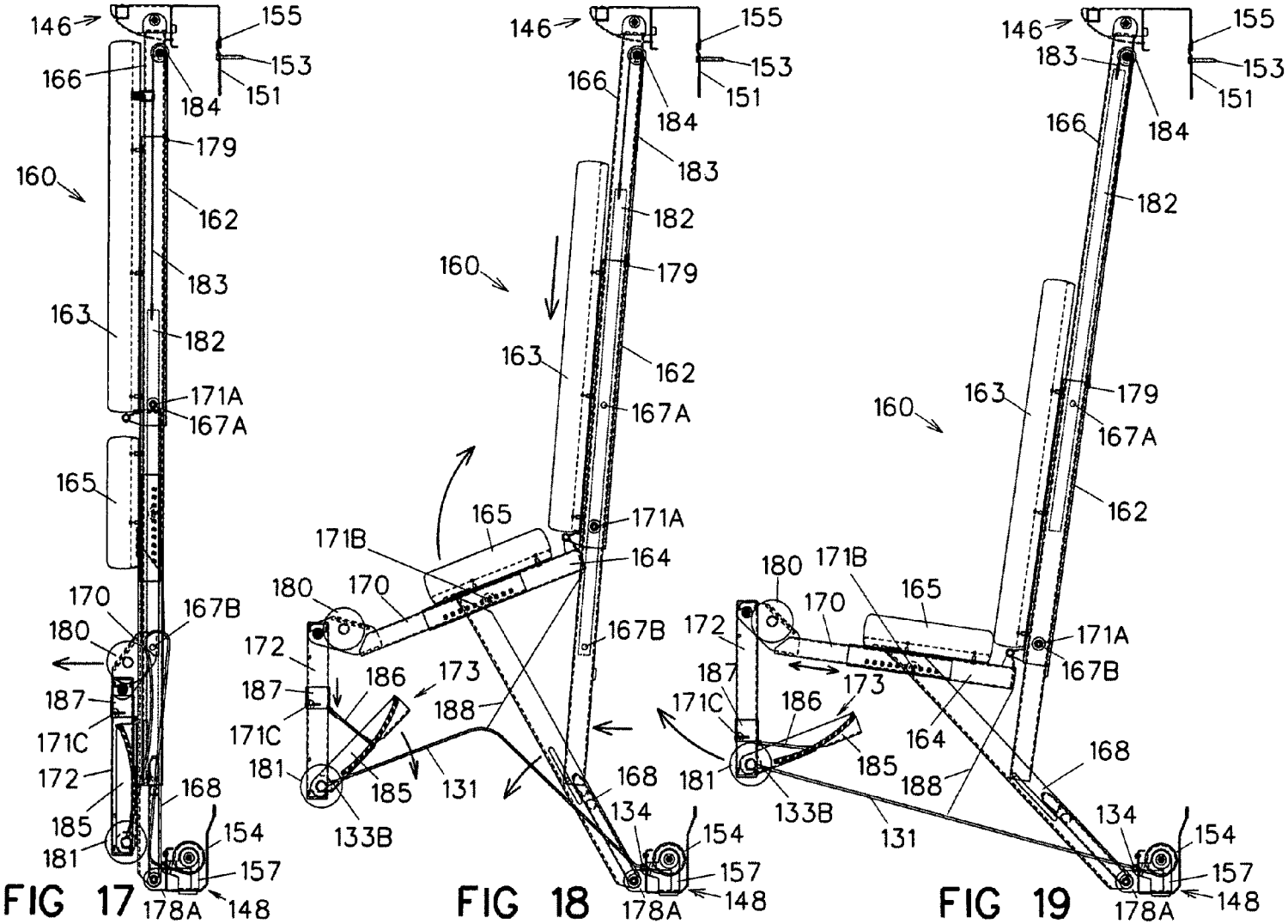
FIG. 17 is a right side view of the seat of FIG. 16 in its storage position.
FIG. 18 is a right side view of the seat of FIG. 16 midway between its storage and operational positions.
FIG. 19 is a right side view of the seat of FIG. 16 folded down into its operational position.

The seat assembly can be collapsed into a near planar configuration in a closed or storage position and be unfolded into a versatile support structure in an open position. As such, the seat assembly is suitable for many exercise machines besides the ones encompassed by the current invention. One embodiment of the seat assembly is seat assembly 160 (FIGS. 1,16-19) that is shown centered in the frame assembly 142 and is comprised of the components described below. Other embodiments are apparent to those of ordinary skill in exercise machines and are encompassed by the invention. In the embodiment shown, guide tube 166, is pivotally connected at its top end to the top frame assembly 146, and at its bottom end is slideably and pivotally connected to a lower member 168 near its middle. The lower member 168 is pivotally attached at its bottom end to support brackets 178A, 178B (FIG. 2) of the bottom frame assembly 148, is slideably and pivotally attached at its middle to the guide tube 166, and is pivotally attached at its top end to a seat 164. The seat 164 is pivotally attached to the lower member 168 near its front end, is pivotally attached to a backrest 162 at its back end, is slideably connected to a thigh support 170 at its front end, and is lockable to the thigh support by lock pin 171B, which engages a plurality of holes in the thigh support 170. The backrest 162 is pivotally attached to the seat 164 at its bottom end, is slideably connected to the guide tube 166, and is lockable to the guide tube 166 by lock pin 171A. Lock pin 171A engages hole 167A in the guide tube 166 when seat assembly 160 is in its storage position and engages hole 167B, located below hole 167A on the guide tube 166, when the seat assembly is in its open position. Thigh support 170 is slideably and lockably connected to the seat 164, and is pivotally connected to leg extension 172 at its front end. The leg extension 172 is pivotally connected to thigh support 170 at its top end, is pivotally attached to cable end 133B at its bottom end, and is slideably and pivotally attached to a fold down bracket 173 at its bottom end. Fold down bracket 173 is comprised of a frame 185 that is pivotally attached to the leg extension 172 at one end, and is pivotally attached to a support 186 near its middle. Support 186 is pivotally attached to the frame 185 at one end and is pivotally attached to a slide 187 at its other end. Slide 187 is slideably connected to the leg extension 172, is pivotally connected to support 186, and has a lock pin 171C that allows the slide to be locked in translation relative to the leg extension when the fold down bracket 173 is in an open position or a closed position. A backrest pad 163 is connected along the full length of backrest 162, a seat pad 165 is attached to seat 164, thigh cushions 180 slide onto thigh support 170, and ankle cushions 181 slide onto leg extension 172. Optional Roman chair arms 174A, 174B (FIG. 16) are hinged at their bottom end to backrest 162 near its bottom end and have folding handgrips 177A, 177B pivotally attached near their free end. Folding handgrips 177A, 177B have lock pins 175A, 175B attached that allow them to be locked relative to the Roman chair arms 174A, 174B in a storage position that is substantially in line with the Roman chair arms and also locked perpendicular to their storage position. The hinged joint of the Roman chair arms 174A, 174B allows them to be put into a storage position where they fold up on either side of the backrest pad 163. When the Roman chair arms 174A, 174B are put in their open position, they fold down and away from the backrest 162 until they are approximately perpendicular to the backrest, at which point the hinged joints stops their rotation. A counterweight 182 (or optionally a spring) slides inside of guide tube 166 and is connected to the backrest 162 by means of cable 183 that attaches at the top end of counterweight 182, travels up to a pulley 184 located in guide tube 166 near its top end, passes around the pulley and runs along the outside of the guide tube 166 until it attaches to the backrest 162 near its top end at attachment point 179. An elastic member 188 is attached at one end to the leg extension cable 131 midway between cable end 133B and cable stop 134, and at its other end to seat 164 near its back end.

Four likely resistance-bearing user interfaces for the exercise apparatus embodiments under discussion are detailed below (FIGS. 1,35). A first is exercise bar 206 that is able to be attached to cable ends 112A, 112B or that fits into a holder 208 when not in use. A second is a pulldown bar 210 that has hooks that allow it to hook over the top of exercise bar 206 for use on pulldown exercises and that fits into holder 208 when not in use. A third are handgrips 214A, 214B which are able to attach to cable ends 112A, 112B or which hook over holders 216A, 216B when not in use. A fourth is a leg strap 218, which is able to attach to either cable end 124A, 124B in a similar manner that handgrip 214A, does and which hooks over holder 216C when not in use.

Operational Aspects

There are two main sets of axes which define the major movements of the exercise apparatus. The first set of axes are the vertical axes 42A,42B. These are the axes about which the rotating structures 43A,43B of the guide assemblies 40A,40B rotate (allowing the arms to rotate in the horizontal direction) and define the axes that the guides 44A,44B of the guide assemblies 40A,40B slide parallel to. The vertical axes 42A, 42B are substantially vertical (for the preferred embodiment) and substantially parallel to one another. They could be set to some angle from vertical but for the preferred embodiment (to minimize floor space) they are positioned vertically. Being set parallel to one another allows for the use of a rigid guide connection 46 used in the preferred embodiment. For some embodiments the guide connection 46 can be disabled, see 'Additional Alternative Embodiments' below.

The second set of axes are the horizontal axes 68A,68B that define the axes that the arms 70A,70B rotate vertically about and the axes at which the arms 70A,70B are rotationally attached to the guide assemblies 40A,40B (either to the guides 44A,44B as shown in the preferred embodiment (FIGS. 5-7) or to rotating structures 43A',43B' as shown in the alternative embodiment (FIGS. 8-10)). The reason the preferred embodiment uses a more elaborate rotating structure is for reasons of counter balancing the arms 70A,70B and the guides 44A,44B in the vertical direction and counter balancing the arms 70A,70B in rotation about the guides 44A,44B. Because the counter weight pulleys 158C and 158F are pivotally attached to the rotating structures 43A,43B, this allows them to rotate horizontally along with the rotating structures 43A,43B and the arms 70A,70B and thereby stay directly centered over the center of gravity of the arm 70A,70B and guides 44A,44B.

The cable reeving of the cable assembly means 108 and specifically the reeving of the arm cable assembly 110 at the pivot end of arms 70A,70B is what allows the arms to rotate without causing a change in the effective cable length of the cable assembly means 108 which would change the position of selector bar 95 and cause it to move relative to the weight stack 94. The preferred embodiment of the resistance assembly provides a preload to the cable assembly means 108 by having a small gap between the lowest resistance setting and the next setting (a gap between no selection (10 lb) and the 20 selection). This preload exerts a force of 5 lb (10 lb/2) on each of the cable ends 112A,112B at the ends of the arms 70A,70B forcing the cable ends against the pulley assemblies 76A, 76B. This preload provides the benefits of helping to prevent the cable ends (and therefore the bar or handgrips) from slipping during rotation or translation of the arms 70A,70B before the start of an exercise (specifically when the arms are rotated in front of the chest for the bench press exercise). If the effective cable length between the cable ends and the selector bar of the resistance assembly changes then this may make it difficult if not impossible to insert the selector pin 96 into the holes provided in the selector bar 95, or may allow the gap between the resistance plates to disappear and thereby lose the preload to the cable ends. Alternative embodiments that use a different means of resistance (such as spring type resistance elements) may make this change in effective cable length a mute point, but for stack weight resistance it is important. Another means of helping to prevent the cable ends 112A,112B from slipping during exercise setup is achieved by the flat spots 69 (FIG. 13) in the pulley structure 77A,77B. These flat spots create a low spot between two high spots which helps prevent the cable ends 112A,112B from moving relative to the pulley structure 77A,77B during movements of the arms 70A,70B such as during the time when the bar is brought in front of the chest prior to doing a bench press exercise. Movement of the cable ends 112A,112B during this setup time would be disruptive.

Figure 28:
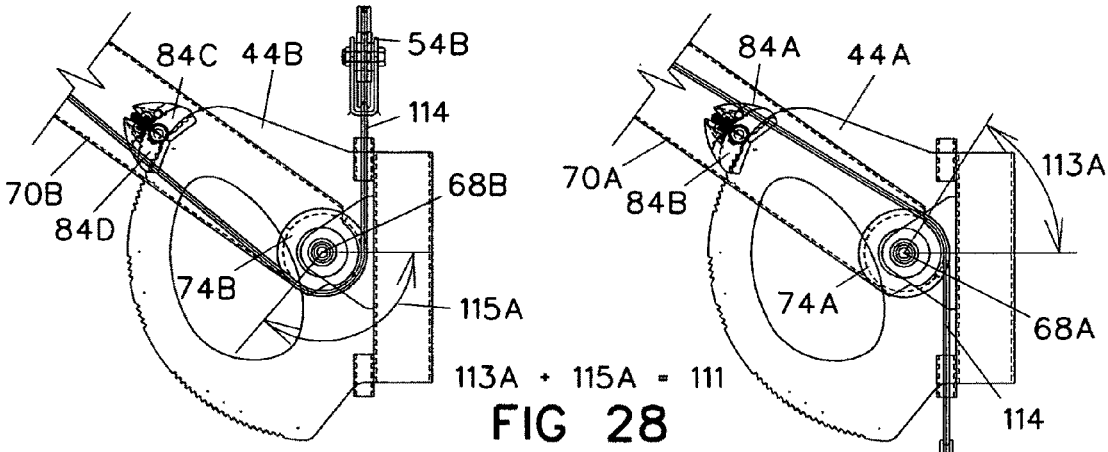
FIGS. 28-30 shows the left and right arms of the preferred embodiment at different angles of rotation and shows how the cable wrap for the left and right arms add up to the same amount of total cable wrap.
Figure 29:
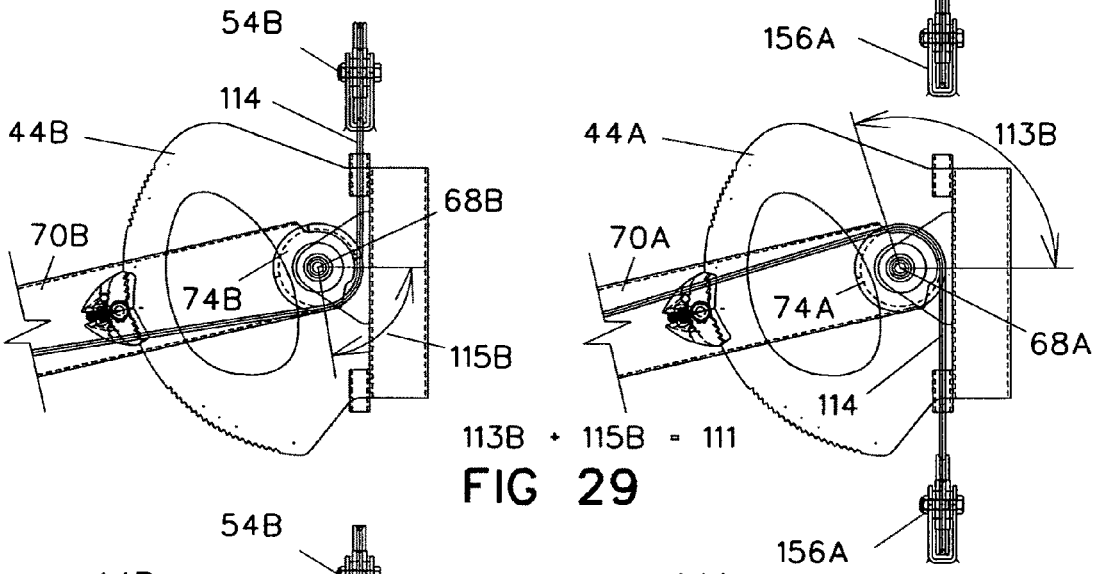
Figure 30:
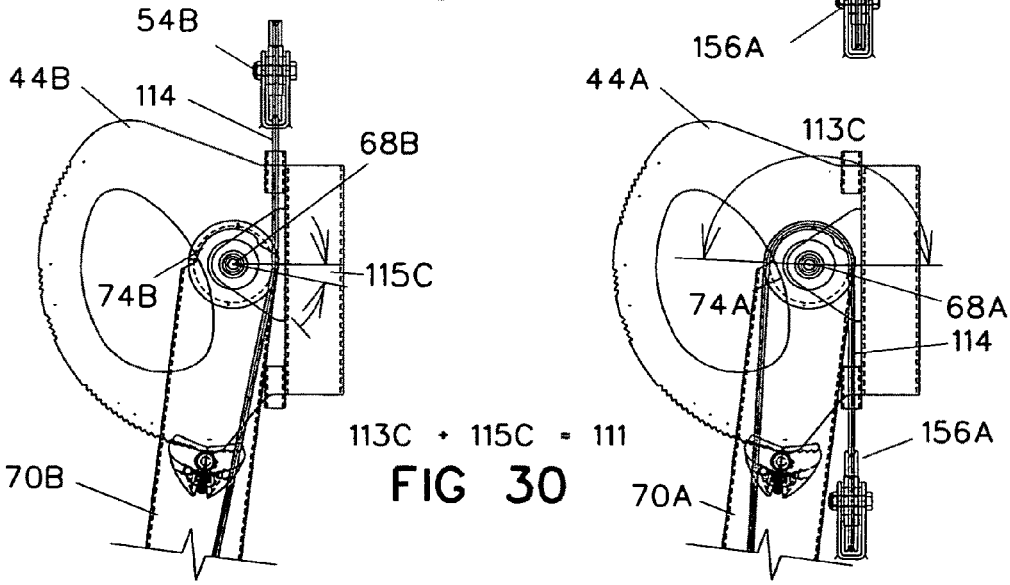

The explanation of wrap-on wrap-off follows. Refer to (FIGS. 28-30). There is a certain amount of cable wrap 113 (A-C) defined by arm cable 114 as it passes over pulley 74A located on the horizontal axis 68A at the pivot end of arm 70A and a certain amount of cable wrap 115(A-C) by arm cable 114 as it passes over pulley 74B located on the horizontal axes 68B at the pivot end of arm 70B, which together add up to a total cable wrap 111. Because the angle that arm cable 114 makes with respect to ground as it exits pulleys 74A, 74B on it's way to pulleys 156A and 54B is always the same and because arm cable 114 exit one pulley going up and exits the other pulley going down, the total amount of cable wrap 111 remains the same irrespective of what angle that the arms are positioned at as long as arm cable 114 always remains in contact with both pulleys 74A and 74B and as long as both arms rotate together. As the arms 70A,70B are rotated the cable wrap on one arm becomes larger by the same amount that the cable wrap on the other arm becomes smaller. Cable wraps onto one while it wraps off the other. Because the total cable wrap 111 remains the same the effective cable length of the cable assembly means 108 remains unchanged.

Figure 31:
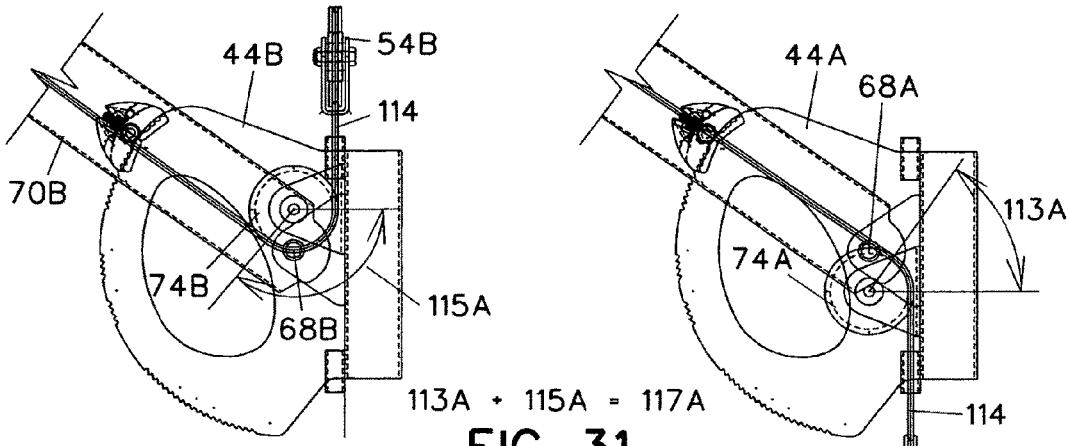
FIGS. 31-33 shows an alternative embodiment that has the pulleys that where mounted on the axis of rotation instead mounted on the guide assemblies. These figures shows the arms at different angles of rotation and shows how the cable wrap for the left and right arms don't add up to the same amount of total cable wrap.
Figure 32:
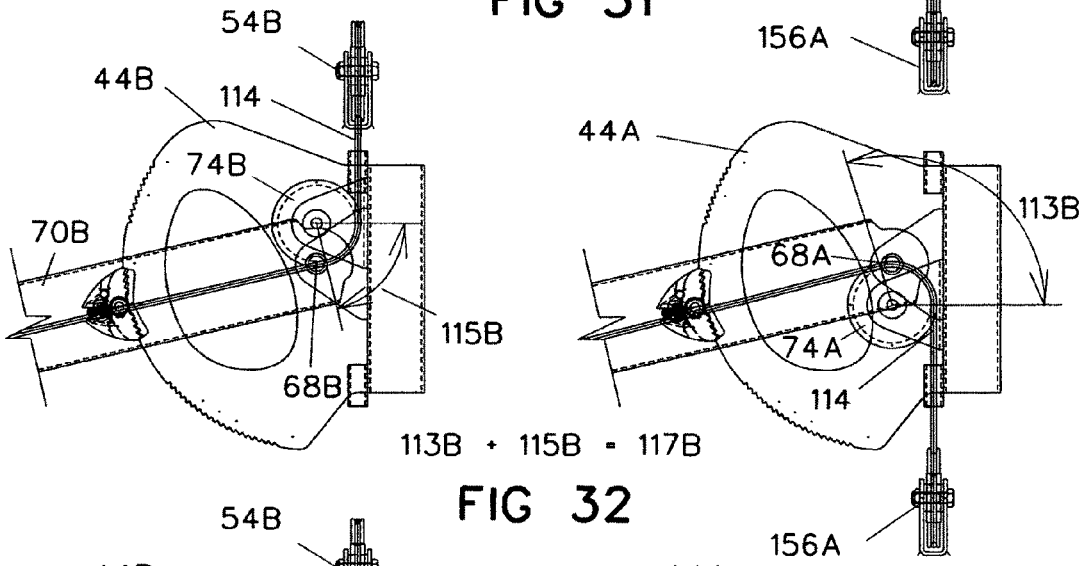
Figure 33:
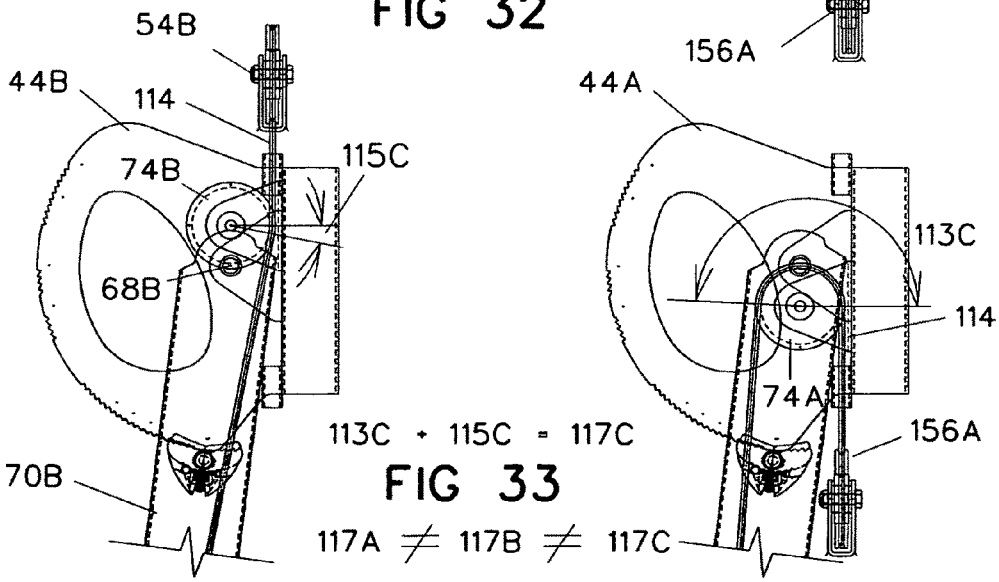

The same principal of wrap-on wrap-off also applies to an alternative case where pulleys 74A and pulleys 74B are not located on the horizontal axes 68A,68B but instead are mounted to the guides 44A, 44B (FIGS. 31-33). The principals above still apply but there is a very slight change in cable length because the amount of cable wrap 113(A-C) and 115 (A-C) do not add up to the same total cable wrap 111 for different positions of rotation of the arms 70A,70B as shown above but instead add up to cable wraps 117(A-C). The amount of effective cable length change can be insignificant (especially if the axes of rotation of the pulleys 74A, 74B are set an equal distance up and down and substantially parallel to the horizontal axes 68A,68B that the arms 70A,70B pivot about and this distance from the horizontal axes is approximately equal to the effective radius of pulleys 74A,74B). This means of cable reeving would therefore be an alternative way to reeve the arm cable 114 over these pulleys. One problem with this alternative reeving method is that a larger portion of the arm needs to be removed to accommodate the pulleys (especially for large rotations of the arms).

Figure 24:
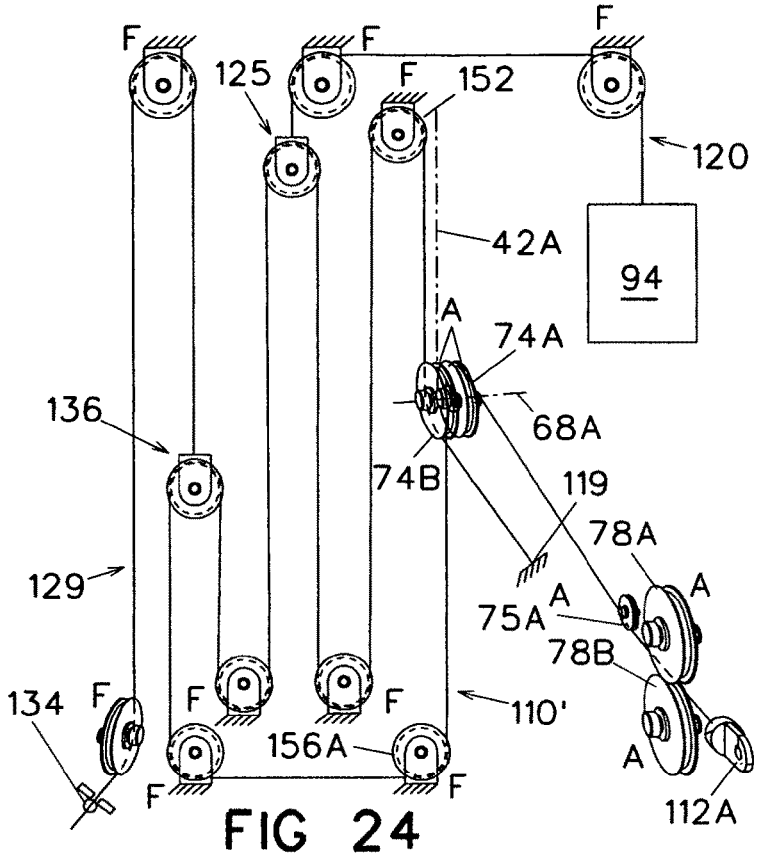
FIG. 24 is a schematic representation of an alternative embodiment showing how to reeve the cables for a single arm and guide arrangement with the pulleys rotating on the axis of rotation of the arm.
Figure 25:
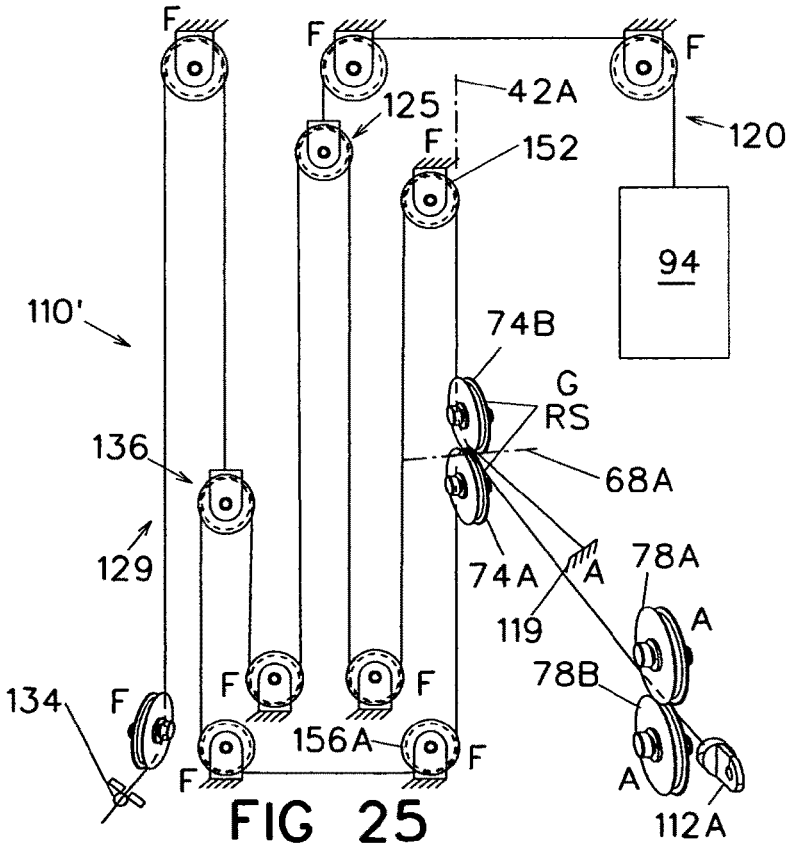
FIG. 25 is a schematic representation of an alternative embodiment showing how to reeve the cables for a single arm and guide arrangement and that shifts the pulleys that were on the pivots of the arm off of the pivots of the arm.
Figure 37:
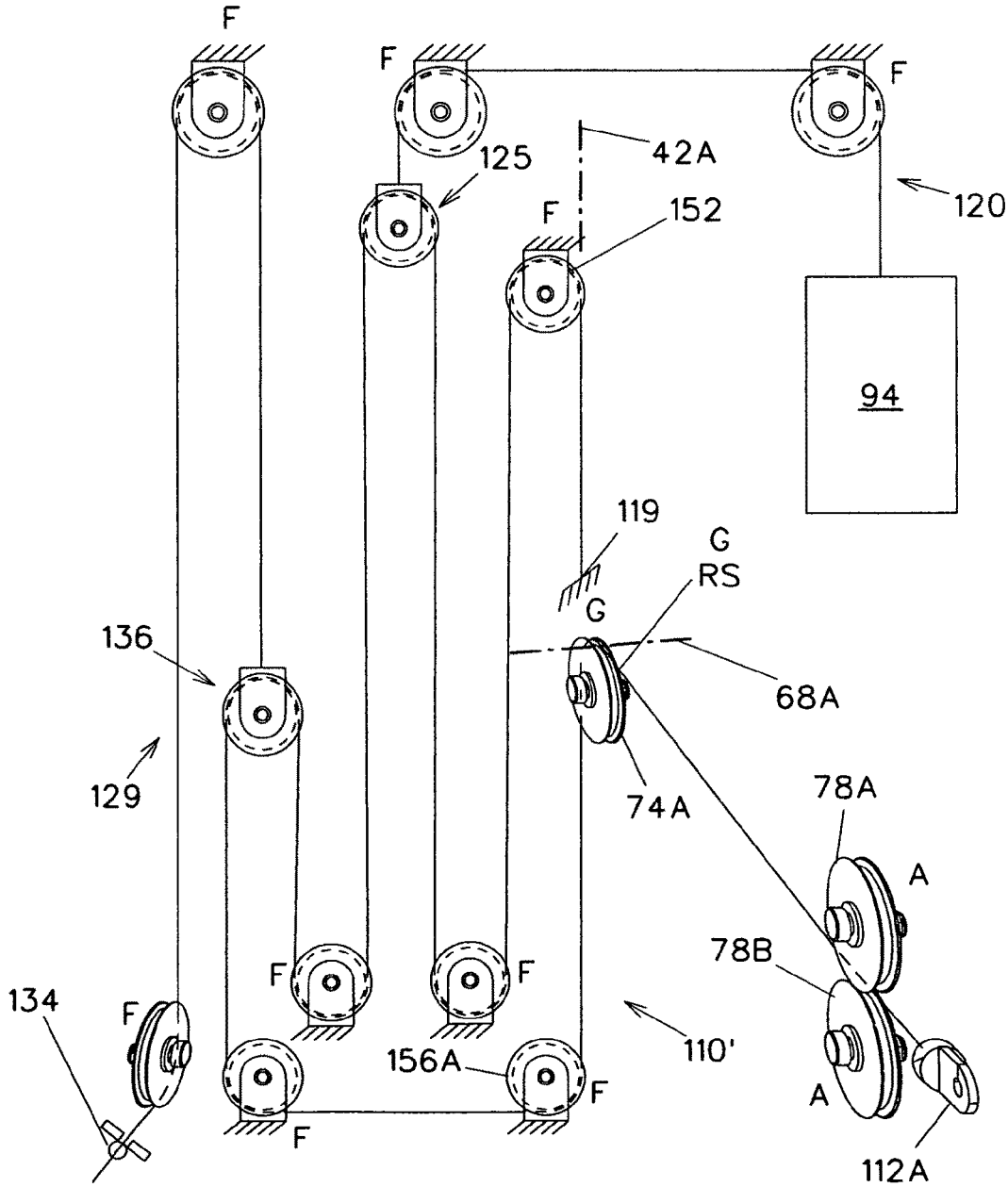
FIG. 37 is a schematic representation of a common cable reeving arrangement that is know and has been revealed in the common art.

The same principal of wrap-on wrap-off applies to the alternative embodiment of a single arm 70A as shown in (FIG. 24). The arm cable 114 exits pulley 74A going down, and then instead of return to the other arm 70B it returns to the same arm 70A from the top. At this point it would wrap around 74B and terminate somewhere on the arm. Alternatively it could wrap over a curved surface with the same effective circumference as the pulley 74A since the cable portion that terminates on the arm wouldn't move relative to the curved surface. One problem with this method is getting the exiting and returning cable segments as close as possible to the vertical axes so that as the arm rotates horizontally there is less angle change for the cable coming into the pulleys from the frame pulleys 152,156A. This can be overcome by of having pulleys 74A,74B on different axis of rotation from the a horizontal axis 68A of the arm 70A as described above (FIG. 25) and so both of pulleys 74A,74B's effective circumference could be positioned on the vertical axis 42A and still have minimal cable length change. Comparing the effective change in cable lengths between the method of the having pulleys 74A,74B on different axis of rotation than the horizontal axis 68A and between a common method of cable reeving (FIG. 37) where the returning cable terminates on the guide instead of wrapping back over an effective circumference equal to pulley 74A is a factor of 21 times greater effective cable length change. This is for the smallest pulley diameter permissible with a common cable diameter used on exercise equipment. As the pulley's effective circumference increases the effective cable length change increases. Although it is significantly more cable length change, because the wrap-on wrap-off method of cable reeving is so small to begin with, the common cable reeving method may also be suitable for a single arm setup especially if a slightly larger gap is used between the top and second plates in the resistance assembly, or the use of some other means of resistance is used.

Wrap-on wrap-off allows for zero effective cable length change for when the arms 70A,70B rotate vertically about the horizontal axes. The vertical translation of the arm and guide assemblies 40A,40B doesn't change the effective cable length or tension of the cable assembly means 108 because the cable ends 112A, 112B of the cable arm assembly 110 terminate in the arms 70A,70B which translates with the guides 44A,44B. Therefore as the arms 70A,70B move vertically the arm cable 114 wraps on and off of the pulleys in the top frame assembly 146 and bottom frame assembly 148 at the same rate therefore unaffecting the effective cable length or tension of the cable assembly means 108. During horizontal rotation of the arms 70A,70B they effectively rotate about the vertical axes 42A,42B regardless of vertical arm rotation because the arm cables 114 exit the arms 70A,70B substantially collinearly to the vertical axes 42A,42B and so the effective cable length change for the arms in horizontal rotation is also effectively zero. Additional benefits of wrap-on wrap-off cable reeving when used on an alternative embodiment of the exercise apparatus where the arms are fixed in horizontal rotation it is explained in the 'Additional Alternative Embodiments' section below.

The number of cable segments used on either side of resistance block assembly 125 also influences the versatility of the invention. In the structure discussed above, by having one cable segments on the top side of pulley block assembly 125 and two cable segments on the bottom side, a 2:1 ratio is created that divides the resistance of the weight stack 94 equally to each of the cable ends 112A, 112B. The cable block assembly 125 also allows each cable end 112A, 112B to be pulled independently from one another, which helps to give the machine the feeling of working out with free weights. Since the resistance of each cable end 112A, 112B is half the resistance of the weight 94, when both cable ends are pulled at the same time, the resistance is the same as what is selected on the weight stack, and the amount of travel available for each cable end is equal to the maximum travel of the weight stack. When an individual cable end 112A is pulled alone, the resistance is equal to half the weight selected on the weight stack 94 and the available travel is equal to twice the maximum travel of the weight stack. For a given exercise, by using an individual cable end 112A, the distance the weight stack 94 travels is half of what it would be when both cable ends 112A, 112B are pulled at the same time. This also makes the velocity of the weight stack during the exercise equal to half that experienced when both are pulled. Since the velocity of the weight stack 94 is half, the momentum of the weight stack is equal to a quarter of the momentum of pulling both cable ends 112A, 112B because momentum is affected by the square of the velocity of the weight stack. Performing specialty exercises with a single handgrip allows the perceived force at the handgrip to be more constant because of the reduced velocity, and therefore momentum, of the weight stack. The weight stack of a preferred embodiment has a total weight of 200 lb (91 kilograms) and a preferred amount of travel of over 58.6 inches (1.49 meters) when using both cable ends 112A,112B at the same time, or 100 lb (45.5 kilograms) and 118 inches (3 meters) of travel when only one handgrip 214A is used. This should provide the necessary resistance and range of motion for the majority of users. Alternatively it may be desirable to have even less inertia and more range of motion than what is shown above. This can be achieved by the use of two weight stacks instead of one. One way to do this would be to use two sets of cables as laid out in (FIGS. 26,27). If the same weight was used in each weight stack that would effectively double the range of motion while keeping the weight the same. For a case such as this it should be understood that cable assembly means 108 would encompasses all the cables used in the gym, and resistance assembly 92 would encompasses all sources of resistance.

The translation lock means 56 and the rotation lock means 82 work in the same manner, by pulling on spring loaded lock pin assemblies 65A,65B and spring loaded ratchet bars 84(A-D) with cables that are attached to activation levers 64,90. The lock pin assemblies are able to stay retracted (FIGS. 14,15) by having the attachment point 89 of the activation lever 90 pass from one side of the pivot 87 to the other when activating the lever. This way the cable 86A (which is spring loaded from the lock pin assemblies) pulling on the activation point 89 keeps the activation lever 90 in the position selected. The difference between the distances 91A and 91B is the travel of the lock pin assemblies 65A,65B and ratchet bars 84(A-D).

The counterweight balances the arms 70A,70B and guide assemblies 40A,40B in rotation and translation to enhance speed of changeover. The weight of the counterweight 102 is equal, preferably, to the combined weight of the arms 70A, 70B, exercise bar 206, guides 44A,44B (and guide connection 46 for the preferred embodiment), which makes them essentially weightless in their vertical translation. The counterweight 102 via cables 104 attaches to the arms 70A,70B at pivots 105A,105B. The location of these pivots 105A, 105B is at a location that balances the combined center of gravity of the arms 70A,70B and exercise bar 206 (when they are positioned horizontally) to the center of gravity of the guides 44A,44B and guide connection 46. This allows the arms 70A,70B, with the exercise bar 206 attached, to be balanced in rotation with respect to the guides 44A,44B and guide connection 46. By making the combined weight of the handgrips 214A,214B the same at the exercise bar 206 the balance is maintained when they are attached instead of the exercise bar 206. Because the arms 70A,70B and guide assemblies 40A,40B with the exercise bar or handgrips is balanced in both rotation and translation, they remain in whatever position they are left in between exercises without the need to engage the vertical rotation lock means 82 or translation lock means 56.

For the preferred embodiment an arm connection means 67 uses the counterweight assembly 100 in conjunction with the guide connection 46 in order to tie the arms together in rotation. If a user were to lift on only one arm, the force from the counterweight 102 that would normally go to that arm would instantly be transferred to the other arm. Because the guides 44A,44B are tied together by the use of the guide connection 46 the extra force to the other arm would make it rise at the same rate and angle as the arm that is being lifted.

Figure 21:
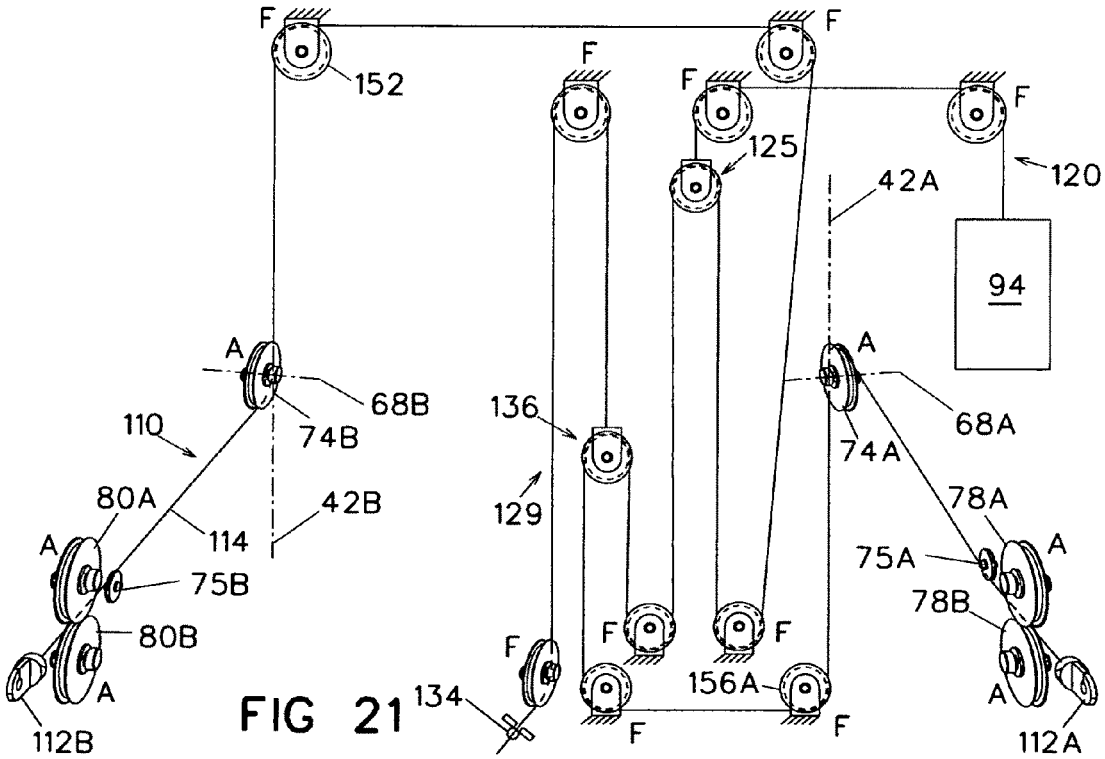
FIG. 21 is a schematic representation of an alternative cable reeving method that doesn't shift the left arm cable over toward the right arm.
Figure 23:
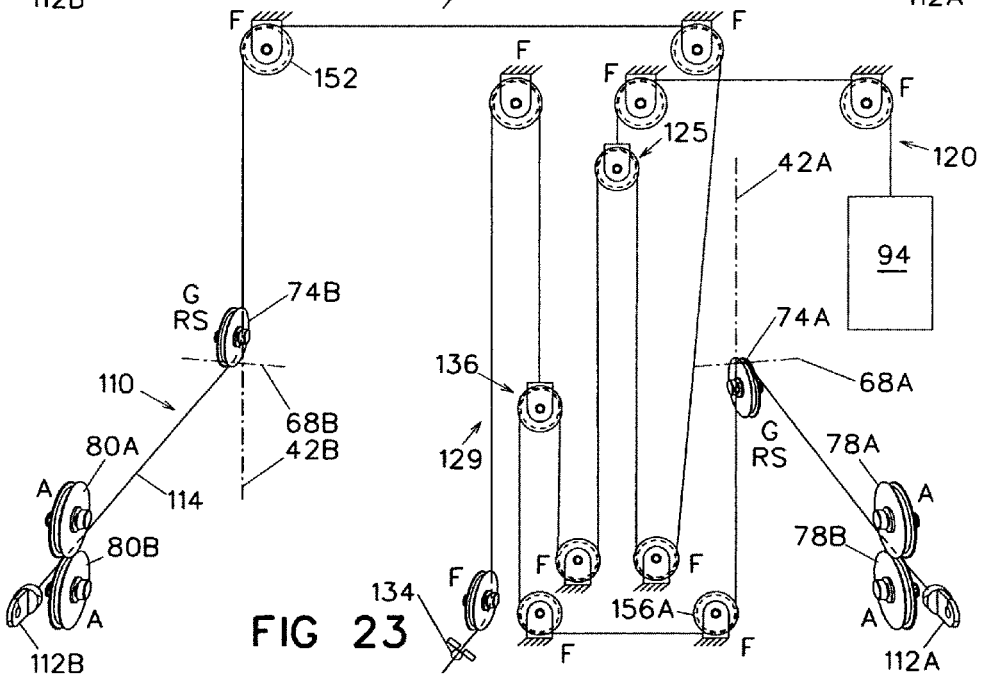
FIG. 23 is a schematic representation of an alternative cable reeving method that shifts the pulleys that were on the pivot of the arms off of the pivots of the arms and that doesn't shift the left arm cable over toward the right arm.

The guide connection 46 along with pulleys 54A and 54B are used in the preferred embodiment to minimize stress on the guides from exercising without engaging the translation lock mean 56. Moving arm cable 114 where it goes vertical from arm 70B collinearly along vertical axis 42B over to vertical axis 42C by the use of pulleys 54A,54B minimizes the overturn moment on the guides. The distance between the location where arm cable 114 goes vertical from both arms times the force being lifted defines the overturning moment. By moving the cable from 42B over to 42C (FIGS. 2,20,22) the overturning moment is approximately $1/20^{th}$ what it would be compared to not moving it (FIGS. 21,23)

The exercise bar is shaped for a variety of different exercises. The straight sections near its ends allow for exercises where gripping a straight bar is best, such as pressing exercises like the bench press. The curved area just inboard of the straight section allows the hands to be rotated for more comfort while doing an exercise like curls, but maintain the center of the hands on the centerline of the bar to eliminate torque on the exercise bar. The bulged area at the middle of the exercise bar 206 allows the bar to give extra clearance for body parts on some exercises such as room for the chest during the bench press or room for the legs during dead lifts.

Elements involving the leg extension are designed to enhance consistency of resistance during leg exercises and increase adjustability for various sized users. A preferred form of the fold down bracket 173 (FIGS. 16-19) has a curved channel as part of frame 185 that keeps the leg extension cable 131 a constant distance from the pivot of where the leg extension 172 is pivotally attached to the thigh support 170. This feature provides a constant resistance to the leg extension during use. The fold down bracket 173 folds out by pulling on lock pin 171C and then pulling on the distal end of frame 185 while moving slide 187 downward until lock pin 171C engage a hole at the bottom of leg extension 172. Optional elastic element 188 (FIGS. 17-19) is there to pull on leg extension cable 131, to move it up and off the floor when the seat assembly 160 is put into its storage position. Thigh support 170 is adjustable for different sized users by pulling on lock pin 171B located on seat 164 while the thigh support 170 is moved in or out and then allowing the lock pin 171B to engage the nearest of a plurality of holes in the thigh support 170.

Figure 41:
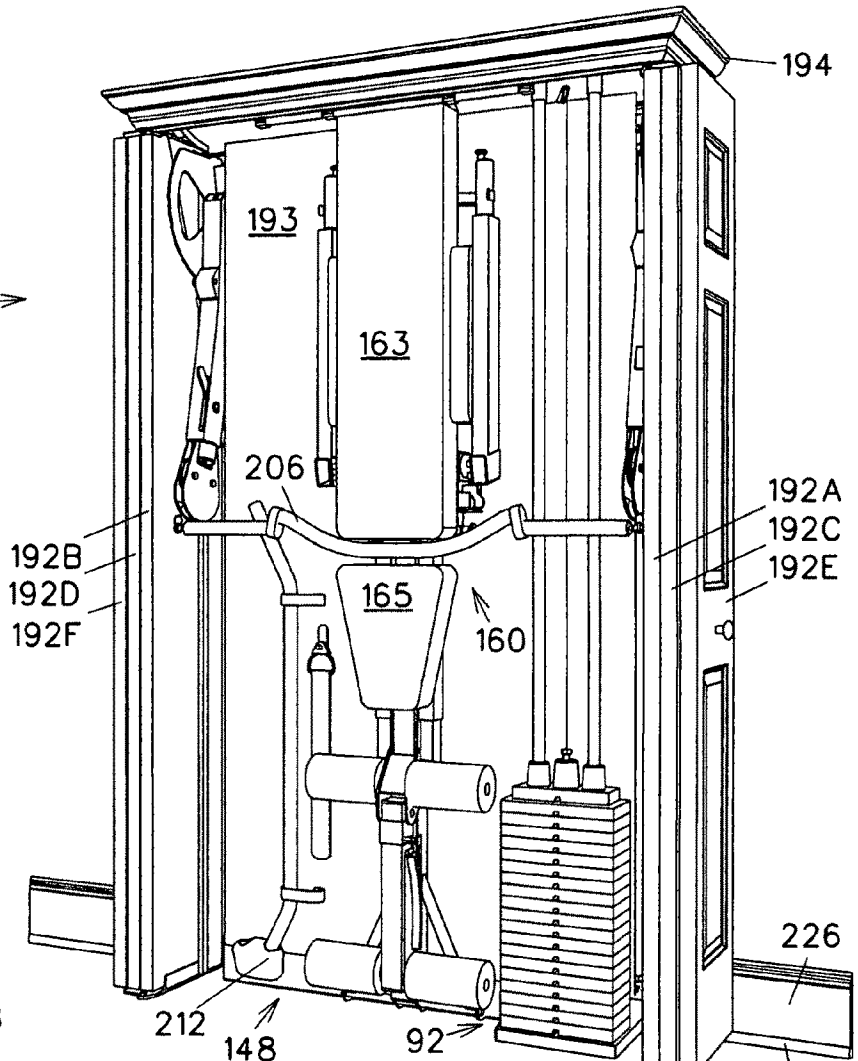
FIG. 41 is a front right perspective of the cabinet enclosure when the doors are just opened.
Figure 40:
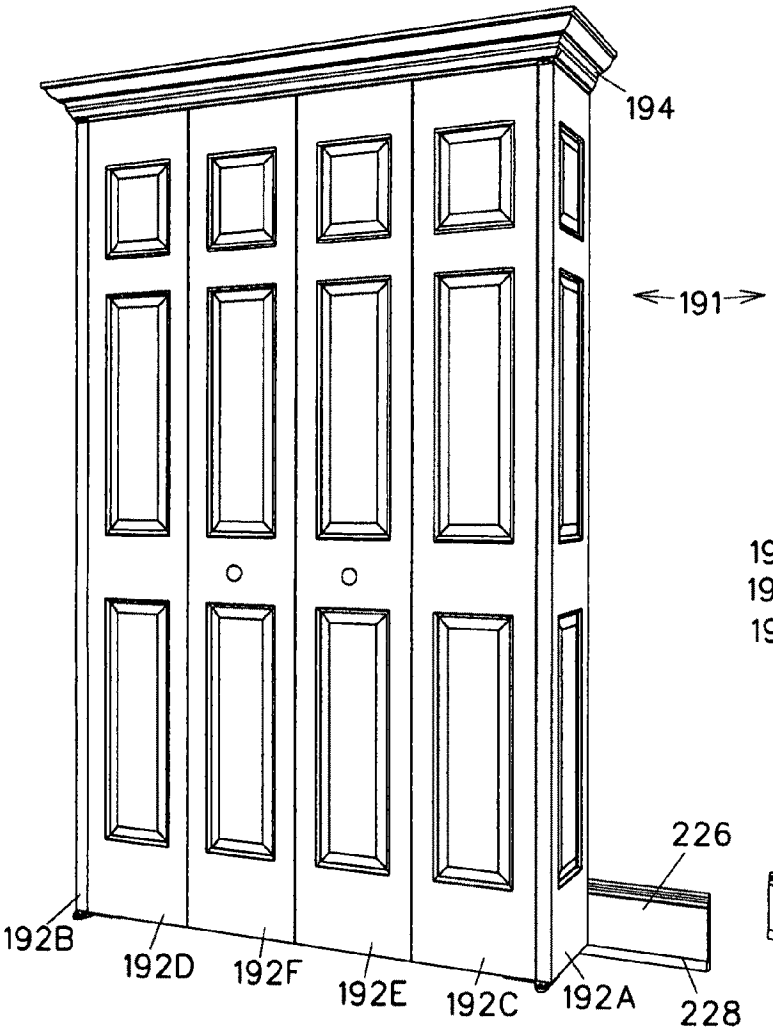
FIG. 40 is a front right perspective of the cabinet enclosure with the doors closed.

The typical footprint of the invention is small and unobtrusive. Some embodiments of the exercise apparatus can be enclosed in a cabinet enclosure 191 (FIGS. 38,40,41) made from standard bi-fold door assemblies like those used on closet openings. The current preferred embodiment uses approximately one foot wide doors 192A,192B on the sides of the cabinet enclosure and four doors 192(C-F) approximately 15" wide each across the front of the enclosure. This is the area into which some embodiments can fit and therefore only takes up 5.8 square feet (0.54 square meters) of floor space. The actual footprint may differ for some embodiments depending on the size, spacing and configuration of elements used. To complete the look of the enclosure, a cove assembly 194 can cover the top frame assembly 146. The frame assembly 142 and cabinet enclosure 191 that has been described above is designed to mount to the wall 222 with space available at the back of the bottom frame assembly 148 to allow the majority of base boards 226 and quarter round 228 from the standard home to fit through untouched. The movement of the front door panels 192(C-F) (FIG. 38) allows their easy placement along side the side door panels 192A, 192B while the exercise apparatus is being used.

The exercise apparatus is of a very compact design which could be shipped fully assembled (minus the resistance assembly if it comprised of stack weights and the arm counterweight if is comprised of a heavy weight, these would be shipped and installed separately). This compact preassembled design benefits the end user in several different ways. First, since it's preassembled, the end user would only need to mount it to the wall (install weights as needed) and they're ready to go. No countless hours of assembly and the frustration that goes along with that. Also there is the benefit of moving the gym to a new location. No disassembly and reassembly needed. Some people, after doing the arduous task of assembly, will just leave their home exercise equipment with the sale of their home because they do not want to have to go through the time and frustration of what they went through when they assembled the gym in the first place.

Figure 11:
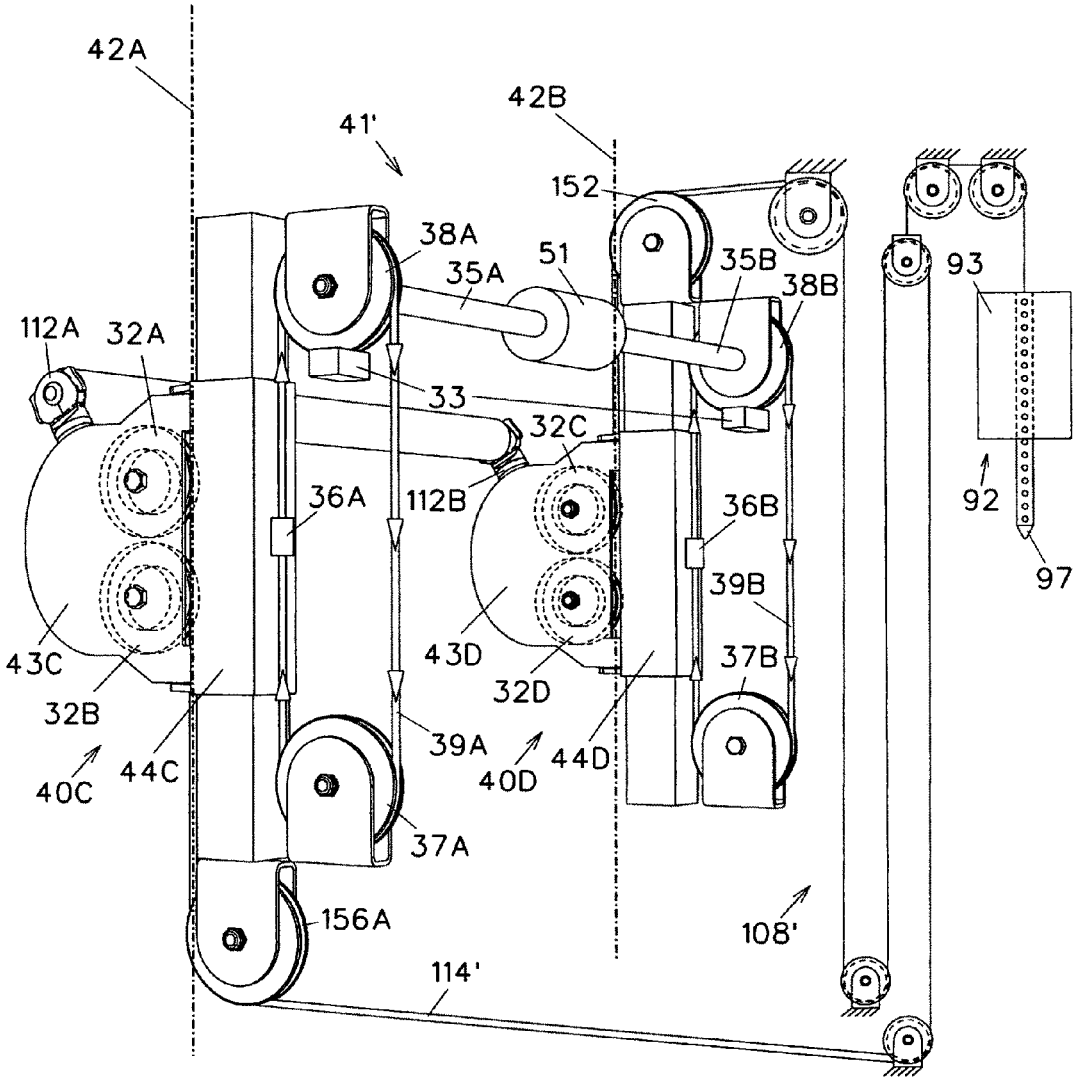
FIG. 11 is a side rear view perspective of a second invention showing the guides and rotating structures and the reeving for tying them together.

I have also invented a versatile exercise apparatus as shown in (FIG. 11) comprising the following: A pair of guide assemblies 40C,40D each comprising a guide 44C,44D and a rotating structure 43C,43D such that the guides 44C,44D are able to slide parallel to vertical axes 42A,42B and the rotating structures 43C,43D are able to rotate about them. The rotating structures 43C,43D each have two pulleys 32(A-D) between which the arm cable 114' passes. The cable reeving is a method as described above, either the wrap-on wrap-off method or the common reeving method. There is a guide connection means 41' for tying the guides together in vertical translation which is achieved by having a continuous loop 39A,39B for each side of the gym which can take load in the axial direction (like as chain for example). These loops over a top pulley 38A,38B and a bottom pulley 37A,37B on each side of the apparatus with one side of the continuous loop 39A,39B being fixed to the guides 44C,44D at connection points 36A,36B. At the top pulleys 38A,38B of the continuous loops 39A,39B are connection tubes 35A,35B which are fixed to the top pulleys 38A,38B and transfer the torque from the top pulleys 38A,38B to a guide connection lock 51. The guide connection lock 51 is able to lock the connection tubes together which forces the guides to translate together. There is a lock means 33 which locks the top pulleys 38A,38B from turning and therefore locks the guides 44C,44D in translation. There is also a resistance assembly 92 with a source of force 93 and a selective means 97 of engaging a portion of that source of force 93. And a cable assembly means 108' for transferring forces from the resistance assembly 92 to the cable ends 112A,112B that are located adjacent to the rotating structures 43C,43D.

Figure 12:
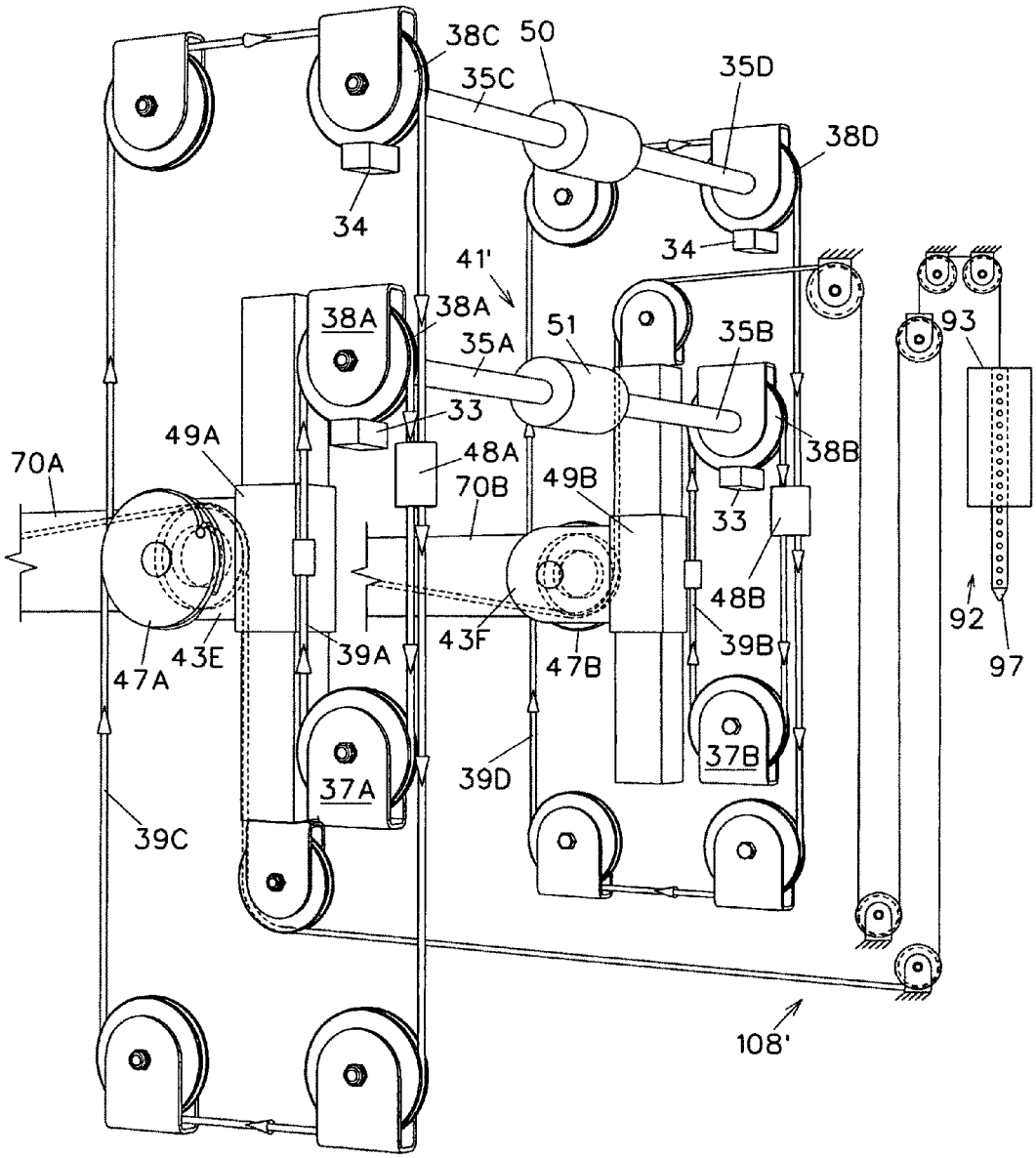
FIG. 12 is a side rear view perspective of the invention of FIG. 11 showing the addition of a reeving method for tying together a pair of arms that have been added to the rotating structures.

An alternative to this is shown in (FIG. 12) where a pair of arms 70A,70B are rotationally attached to the rotating structure 43E,43F of the invention above. The arms have cable ends at their free ends and are reeved to a resistance assembly 92 in one of the manners described above. The arms 70A,70B at their pivots are each connected to a pair of sprockets 47A, 47B. The chain ends in the front portion of a continuous loop 39C,39D wrap on to each of these sprockets 47A,47B, one from the top and the other from the bottom. The chains in the back portion of the continuous loops 39C,39D runs past the back portion of the continuous loops 39A,39B for the guide connection means 41' explained above. Each arm has a chain lock means 48A 48B which locks these two continuous loops 39 (A-D) together thereby forcing the arms 70A,70B to stay at a relative rotation to the guides 49A,49B. At the top portion of the continuous loops 39C,39D are connection tubes 35C, 35D which are fixed to the top pulleys 38C,38D and transfer the torque from the top pulleys 38C,38D to an arm rotation connection means 50. The arm rotation connection means 50 is able to lock the connection tubes 35C,35D together which then force the arms 70A,70B to rotate together as one arm. There is also a rotation lock means 34 which locks the top pulleys 38C,38D from turning and thereby locks the arms 70A,70B in rotation.

Additional Alternative Embodiments

Figure 8:
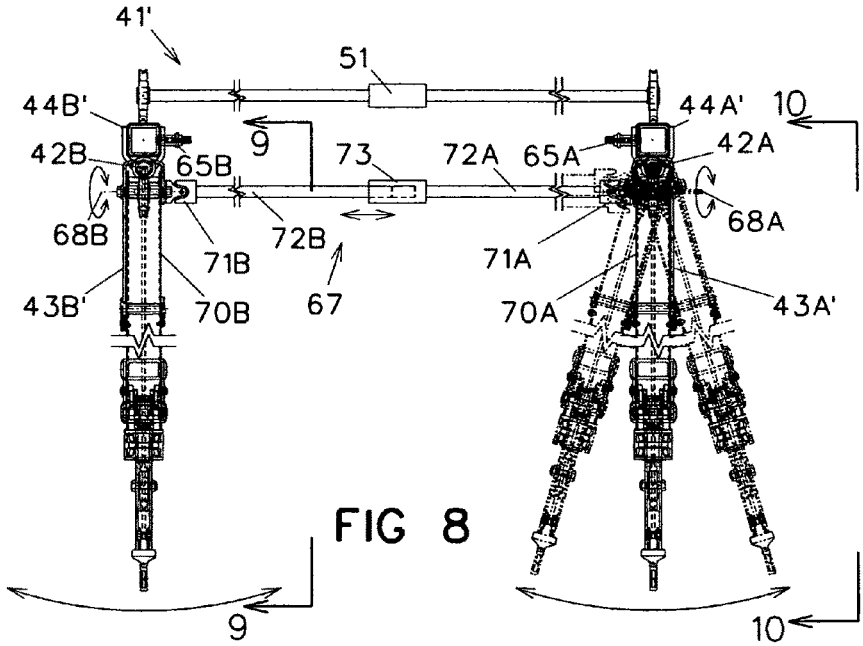
FIG. 8 is a top view perspective of an alternative embodiment showing the arms and guide assemblies and the horizontal rotation range of motion.
Figure 9:
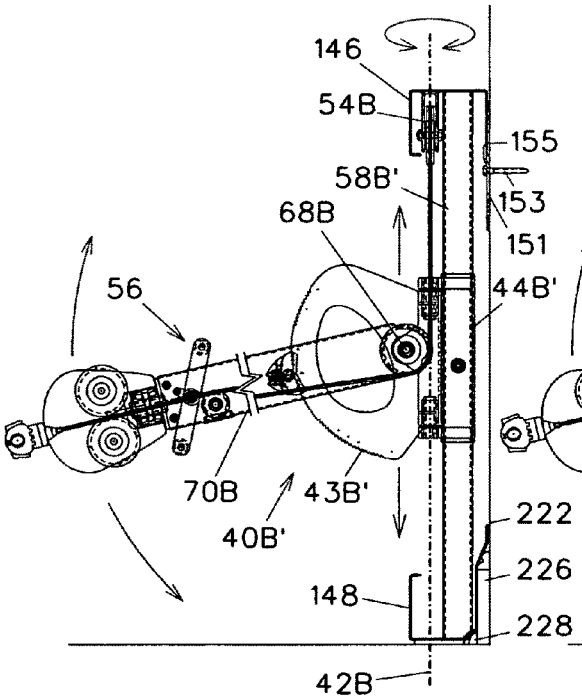
FIG. 9 is a section view from FIG. 8 that shows the right side view perspective of an alternative embodiment showing the left arm and the left guide assembly.
Figure 10:
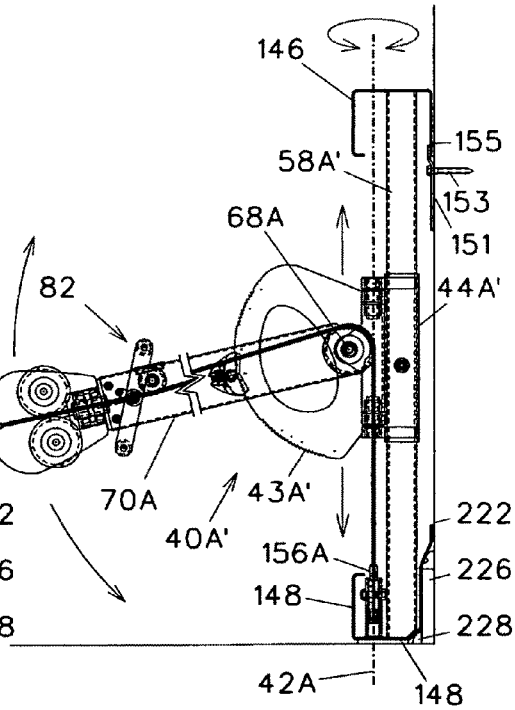
FIG. 10 is a section view from FIG. 8 that shows the right side view perspective of an alternative embodiment showing the right arm and the right guide assembly

An alternative embodiment is described below and shown in (FIGS. 8-10). In this alternative embodiment the arms 70A,70B are pivotally attached to the rotating structures 43A',43B' at the horizontal axes 68A,68B. The rotating structures 43A',43B' are pivotally attached to the guides 44A',44B' at the vertical axes 42A,42B. And the guides 44A',44B' are slideably attached to vertical square tubes 58A',58B', which allow them to slide but not rotate about the centerlines of the vertical square tubes 58A',58B'. The guide connection means 41' is achieved using the second invention listed above. An arm connection means 67' is achieved by the use of universal joints 71A,71B mounted to arms 70A,70B near their pivots and connecting tubes 72A,72B are mounted at one end to the universal joints 71A,71B and are slideable tied together on their shared centerlines at their other end. A connecting tube lock 73 is located in the area where they can slide axially relative to one another. The connecting tube lock 73 allows the connecting tubes 72A,72B to still slide relative to one another but locks the connecting tubes 72A,72B together in rotation. When the connecting tube lock 73 is activated, as one arm is raised the other arm raises also provided the guide connection lock 51 is also activated (which for this embodiment would need to always be activated).

One benefit of the alternative embodiment is that the arms are able to rotated to different positions of vertical rotation relative to one another (provided a cable reeving method like FIGS. (22-27) or 37 is used). The reason the preferred embodiment is preferred to this embodiment has to do with the means of counter balancing the weight of the arms in rotation with respect to the guides. Because there is no ease way to have the counterweight pulleys 158C,158F follow the horizontal rotations of the arms a different means is needed. Something that puts a torque onto the connecting tubes 72A, 72B will also put the same torque onto the guides 44A',44B' potentially causing them to bind against the vertical square tubes 58A',58B' and thereby make adjusting the guides 44A', 44B' more difficult. A separate counterweight would also need to be used to counterbalance the complete arm and guide assembly.

An alternative embodiments is described below and is shown in (FIGS. 26,27). This embodiment uses a separate cable assembly means 108 and resistance assembly 92 for each arm 70A,70B. Each arm 70A,70B has an arm cable assembly 110' comprising a cable end 112A that is positioned at the distal ends of the arms 70A,70B, an arm cable 114 that puts it in communication with the resistance assembly 92 for that arm, and a cable end 119 which terminates near the pivot end of the arm, either using wrap-on wrap off as described above (cable terminates on the arm) or the common reeving method shown in (FIG. 37) where the cable end 112B terminates on the guide. In addition the alternative embodiment has a guide connection means 41 or 41' and an arm connection means 67 or 67' as described in the preferred embodiment or one of the alternative embodiments.

The benefits of this arrangement are the same as for the invention but also gives the ability to have two sources of resistance which for some applications is desirable. Especially where long travels of the cable ends are desired or were fast movements of the cable ends are desired. The draw backs are the added complexity and extra parts needed. Also the added weight (if a stack weight resistance was to be used). To simplify the cable reeving (FIG. 27) shows the leg extension cable reeving one side removed.

Figure 39:
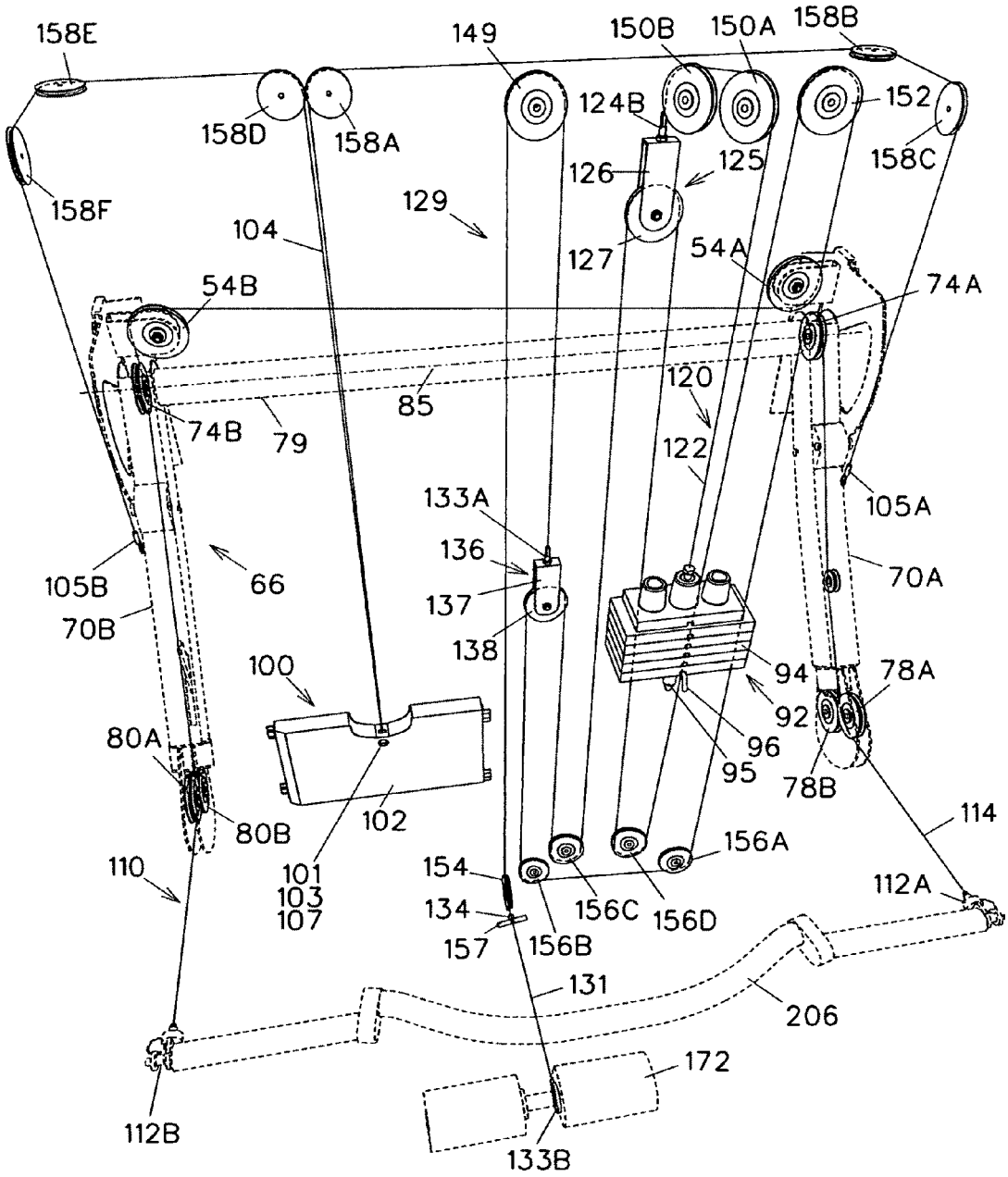
FIG. 39 is a front top perspective of a the parent application utilizing the wrap on-wrap off cable reeving method and a connection tube on the shared axis of rotation.

An additional alternative embodiment that has the arms of the gym permanently connected together with a connection tube 79 centered on their shared horizontal axes 85 (FIG. 39). This is possible by using the wrap-on wrap-off cable reeving method described above. Tying the arms 70A,70B together forces the arms to act as one arm assembly 66 with no horizontal rotation and so would have the same functionality as the parent application's preferred embodiment but with the added benefits described below. The wrap-on wrap-off cable reeving method would increases the range of motion of the cable ends 112A,112B because now the cable reeving runs vertically (which although it is show in the parent application for an alternative cable reeving method which shows how the cable reeving can also run vertically, doing so would increase the depth of the gym considerably because of the way the connection tube for connection the arms together is located which is not centered on the axis of rotation but is off center from it). So using the wrap-on wrap-off reeving method frees up considerably more usable space between the arms 70A, 70B and behind the back panel 193 (not shown for clarity). This allows the counterweight 102 to be moved behind the back panel 193 with room to spare for running the cable reeving vertically. Running the resistance block assembly 125 vertically provides for more range of motion at the cable ends 112A,112B because the range of motion for the parent gym is confined by the width of the arms 70A,70B. This is because this is where the resistance block assembly 125 (which connects the arm cable 114 to the resistance cable 122) runs. Running the resistance block assembly 125 vertically in the area of extra space created by using a connection tube 79 centered on the shared horizontal axes 85 of the arms 70A,70B allows for a 2:1 cable reduction between the arm cable 114 and the resistance cable 122 which requires less pulleys be used. The extra space also allows for larger pulleys for arm cables 114 to run on and thus allows heavier gauge arm cables to be used. The extra space also allow for a larger diameter connection tube 79 with a thinner wall thickness making it and the entire arm assembly 66 stiffer, lighter and easier to manufacture. The lighter arm assembly 66 also lightens the counterweight 102 making the combined weight and inertia for the arm, guide and counterweight assemblies considerably less. The decreased weight of these assemblies helps to make moving the arms and guide assemblies easier, decreases material expenses, and decreases shipping costs.

CONCLUSION, RAMIFICATIONS, AND SCOPE OF TILE INVENTION

While the above description contains many specificities, these should not be construed as limitations on the scope of the invention, but rather as an exemplification of one preferred embodiment thereof. Many other variations are also possible. For example:

An additional alternative embodiment would use electronic locks means instead of mechanical lock means to engage and disengage the vertical rotation lock means 82 and the translation lock means 56. So instead of mechanical activation levers 64,90 the lever could be place to grip the arms to aid in their movement and would have incorporated into them a sensor that would disengage the locks when grabbed during movement of the arms in vertical rotation and translation. There would also be a limit sensor that would prevent the disengagement of the locks if the weight stack or resistance assembly is engaged. There could also be some easier means of engaging and disengaging the lock for the rotating structure. Possibly a foot activated lock that when stepped on would lock the lock pins in a disengaged location and then when stepped on again would engage the spring loaded pins so that they would engage the next hole positioned under it.

In addition to the electronic locking means there could also be means for moving the guides in vertical translation, the arms in vertical and horizontal rotation, change the resistance levels and move the seat assembly in and out. Small servo motors in the exercise apparatus could be used to place the arms into preferred positions for different exercises. The servo motors would be strong enough to quickly and quietly move the different parts but not strong enough to do anyone or anything any harm or damage (the use of force sensors would sense an overload condition and release the motors such as would be experienced when hitting an obstruction). Buttons on the machine could be used to place the arms into common positions such as top position (T1, T2, or T3 depending on the height of the user where T1 is the max arm position for the machine), bottom position, curl position (again C1, C2 or C3 depending on the height of the user), bench press position (B1,B2 or B3), Squat position, etc. It may be easier for a user to first select their height range (H1 for say heights taller than 6'2", H2 for heights from 5'9" to 6'2" and H3 for heights below 5'9" as an example), then the user would only need to select their desired exercise activity. There would also need to be an up down arrow to manually override the current position once the bar is in position to fine tune the arm placement and likewise to fine tune the resistance assembly.

With these ideas in mind this could be expanded even more and could be incorporated into a commercial gym offering with even more features. Each user would have a magnetic card with their workout information on it that could be swiped through a card reader on the exercise machine to let the machine know the preferences of the user. This information would include every detail of a user's workout including the exercises performed, resistance settings, sets performed, order of the exercises and sets, and the corresponding position of the arms in vertical and horizontal rotation and vertical placement for each of these sets. Different workout days used for different body parts (legs workout, back, etc) would also be saved on the cards and different variations of each of these workouts could also be saved. Only the exercise attachments would need to be changed out manually by the user. This would allow a user to stay at one exercise location and get a complete body workout without the need to go to different exercise stations and wait to work in. It would also allow a user to do supersets of completely different exercises with little wait time between sets and without the need to tie up two or three different exercise workout stations at the same time. It allows for the user to customize and update their workout on the fly. By keeping their workouts saved on the magnetic cards it helps the user remember the order and intensity of their favorite workouts. They don't need to remember where to set the arms, at what height or rotations and what resistance levels they used the last time they worked out. Also all of the information about each workout could be saved after each workout. This could then be printed out when desired to show the dates of each workout, time, duration, exercises performed, number of sets, repetitions and resistances used.

Even the speed of each repetition and therefore the horsepower exerted could be saved which could then be converted into calories burned etc.

Voice recognition could also be a feature which could be incorporated into the machine. This could be used in place of, but more likely in addition to a manual keyboard for inputting information. An example, it could be used to change the resistance level of the machine, by saying 'more' or 'less'. To change the guide's height position the user would say 'up' or 'down'. To move the seat the user would say 'in' or 'out'. These features could be used before starting the exercise and even during the exercise (provided the user momentarily stops the exercise to remove any forces on the resistance assembly or arm assembly). Let's say that during a bench press exercise the user decides that the resistance level is not high enough. The user would momentarily stop and say 'more' and the resistance mechanism would notch up (say 5 lb) or the user could say 'more 15' and it would notch up 15 lb. Likewise at the end set to get a few more repetitions in the resistance could be lowered. The arm height could also be changed. Let's say the user during a set of bench press decides the arm is to low. Again the user would momentarily stop and say 'up' and the arm would move up one notch (on the preferred embodiment the notches in the area of the bench press are ¾" apart). Or if he decided he wanted to move into an incline bench press he would say 'up 3' and it would move up three notches (2.25" on the preferred embodiment).

Any changes made during the workout could be made permanent by adding the word 'permanent' after the changes is made. The following would be an example. The machine has just changed over to the bench press and is ready for the first set with the warm up resistance set at 150 lb. The user decides this is to light and says 'more 10 permanent' and it would change the weight to 160 lb and make the change permanent. The user would then be asked at the end of the workout to save the details about the workout and also to save any changes made during the workout. The user would then swipe the card to save their workout details and to save the permanent changes either to the current workout or elect to save the changes to a new workout under a different name.

Another feature would be the ability to allow another user (or the same user) to jump into the machine between sets and do an exercise. This could be done by just saying or selecting a different exercise even though the machine is set up for something different. If it is the same user there is the option of making this addition to the workout permanent. After the exercise is performed the machine would ask to resume with the workout. In a similar vane, if the user is not having a good day they could say or select 'skip' to skip a set.

Another possibility would be to allow two or even three people to work out on a machine at the same time. Instead of just jumping in to do one or two sets, a new user could be added. They would select 'add user' and then swipe their info into the machine and the machine would alternate between each of the people entered allowing each their own individually saved workouts. They could do this at the beginning of each of their workouts or users could be added as other users end their workouts. This would allow the facility to have fewer machines for an equal number of users by utilizing the rest time that users take between individual sets. In the home (even without the automatic positioning) because of the ease of switching between exercises, two people could easily alternate between exercises and use the gym at the same time.

As can be seen, the exercise apparatus of this invention is a highly versatile exercise apparatus capable of providing a full body workout to the vast majority of users at a single workout station. An exercise apparatus that does not control the path of motion of the user interfaces and allowing the cable ends to act independently from one another. Allows for quick and easy transitioning of the arms to different exercise positions without have to change a lot of control levers, remember how one side was set up with respect to the other, or have to remove and reattach the straight bar. And when the workout is done, the exercise apparatus can be stored out of sight in a decorative cabinet that takes up a minimal amount of floor space.

Although the description above contains detailed descriptions of some embodiments, the details should not be construed as limiting the scope of the invention but as merely providing some of the presently preferred embodiments of this invention. Thus the scope of the invention is meant to be determined by the appended claims and their legal equivalents, rather than by the examples given.

I claim:

1. An exercise apparatus comprising:

a first guide assembly comprising a first guide able to slide parallel to a first vertical axis and slidably connected to a first rotating structure able to rotate about the first vertical axis;

a second guide assembly comprising a second guide able to slide parallel to a second vertical axis substantially parallel to the first vertical axis and slidably connected to a second rotating structure able to rotate about the second vertical axis;

a first arm including a distal end and a pivot end pivotally coupled to the first guide at a first horizontal axis substantially perpendicular to the first vertical axis;

a second arm including a distal end and a pivot end pivotally coupled to the second guide at a second horizontal axis substantially perpendicular to the second vertical axis;

a first pulley assembly comprising a first pulley structure rotationally attached to the distal end of the first arm and that contains at least one pulley;

a second pulley assembly comprising a second pulley structure rotationally attached to the distal end of the second arm and that contains at least one pulley;

a guide connection means comprising, the first guide, the second guide, and a guide connection with the ability to tie the first and second guides together so that they are constrained to slide together as one unit;

a resistance assembly comprising a first source of force and a selective means of engaging a portion of the first source of force;

a cable assembly means for transferring force comprising a first cable end positioned adjacent to the first pulley structure and a second cable end positioned adjacent to the second pulley structure, such that the first and second cable ends are in communication with the resistance assembly; and a first user interface attachment comprising two hand grips pivotally connectable to the first and second cable ends.

2. The apparatus of claim 1 further comprising, an arm connection means with the ability to tie together the first and second arms whereby both arms rotate together in vertical rotation about their own respective first and second horizontal axes at the same angle with respect to ground at the same time, without undue effort to cause them to rotate at different angles from each other.

3. The apparatus of claim 1, wherein the first and second arms further comprise, a vertical rotation lock means for locking the vertical rotation of the first and second arms relative to the first and second guides at a plurality of rotations.

4. The apparatus of claim 1, wherein the first and second guides further comprise, a vertical translation lock means for locking the vertical translation of the first and second guides relative to the first and second rotating structures at a plurality of locations along the first and second vertical axes.

5. The apparatus of claim 3 wherein the vertical rotation lock means further comprises, a vertical rotation lock release lever that locks and unlocks the vertical rotation lock means for the arms from one lever which remains activated in the locked and unlocked positions on its own until further activation.

6. The apparatus of claim 4 wherein the vertical translation lock means further comprises, a vertical translation lock release lever that locks and unlocks the vertical translation lock means for the guide assemblies from one lever which remains activated in the locked and unlocked positions on its own until further activation.

7. The apparatus of claim 1 further comprises, a first pulley located proximate the pivot end of the first arm whose effective circumference is substantially tangent to the first vertical axis, a second pulley located proximate the pivot end of the second arm whose effective circumference is substantially tangent to the second vertical axis, an arm cable that runs from the first cable end, wraps over the first pulley, and exits it in a first direction substantially collinear to the first vertical axis, proceeds to communicate with the resistance assembly, and is travelling in the first direction substantially collinear to the second vertical axis just before wrapping over the second pulley and then terminating at the second cable end.

8. The apparatus of claim 1, further comprising, a counterweight assembly comprising, a counterweight means for applying a counter balancing force that is in communication with the arms, wherein the counterweight means has sufficient force to counterbalance the weight of the first user interface, the arms, the guide connection, and the guides in order to allow them to be able to translate vertically and rotationally with minimal resistance;

a counterweight cable assembly that is in communication with said counterweight means and pivotally connects to the arms a predetermined distance from their pivot end.

9. The apparatus of claim 1, further comprising, a backrest having a top and a bottom wherein the backrest is substantially vertical in a closed position is suitable to be leaned against during exercise activity in an open position.

10. The apparatus of claim 1, wherein the first and second rotating structures further comprise, a horizontal rotation lock means for locking the horizontal rotation of the first and second rotating structures relative to ground at a plurality of rotations.

* * * * *